US007364279B2

(12) United States Patent
Usui et al.

(10) Patent No.: US 7,364,279 B2
(45) Date of Patent: Apr. 29, 2008

(54) INK-JET PRINTER WITH AIR-DISCHARGE-FLOW ASSURING MEANS

(75) Inventors: Takamasa Usui, Nagoya (JP); Masayuki Takata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 341 days.

(21) Appl. No.: 11/073,874

(22) Filed: Mar. 8, 2005

(65) Prior Publication Data

US 2005/0212873 A1 Sep. 29, 2005

(30) Foreign Application Priority Data

Mar. 26, 2004 (JP) ..... 2004-092314
Mar. 26, 2004 (JP) ..... 2004-092315
Mar. 26, 2004 (JP) ..... 2004-092316

(51) Int. Cl.
*B41J 2/17* (2006.01)
*B41J 2/175* (2006.01)

(52) U.S. Cl. ..... 347/84; 347/86

(58) Field of Classification Search ..... 347/84, 347/86, 87; 141/2

See application file for complete search history.

(56) References Cited

U.S. PATENT DOCUMENTS 5,280,300 A * 1/1994 Fong et al. ..... 347/87
2001/0052370 A1* 12/2001 Shinada et al. ..... 141/2
2004/0183873 A1* 9/2004 Steinmetz et al. ..... 347/86

FOREIGN PATENT DOCUMENTS

JP A 2000-103084 4/2000
JP A 2002-240310 8/2002
WO WO2004069545 * 8/2004

* cited by examiner

*Primary Examiner*—Stephen Meier
*Assistant Examiner*—Carlos A. Martinez, Jr.
(74) *Attorney, Agent, or Firm*—Oliff & Berridge, PLC

(57) ABSTRACT

An ink-jet printer, including: a printing head for performing printing on a print medium by ejecting ink from nozzles; an ink tank for storing the ink to be supplied to the printing head; an ink passage through which the ink is supplied from the ink tank to the printing head; a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber and having: a valve portion which opens and closes the communication opening and which includes a sealing member; and a rod portion connected to the valve portion, wherein the air-discharging device further includes air-discharge-flow assuring means for assuring a discharge flow of the air flowing from the buffer tank through the air-discharge passage.

26 Claims, 18 Drawing Sheets

INK-JET PRINTER WITH AIR-DISCHARGE-FLOW ASSURING MEANS

This application is based on Japanese Patent Application Nos. 2004-092314, 2004-092315, and 2004-092316 filed on Mar. 26, 2004, the contents of which are incorporated hereinto by reference.

BACKGROUND OF THE INVENTION

1. Field of the Invention

The present invention relates to an ink-jet printer, in particular, an ink-jet printer capable of accumulating air bubbles generated in ink passages and discharging the air bubbles.

2. Discussion of Related Art

To assure a reduction in the size (the thickness) of an ink-jet printer, there is a demand for a reduction in the size (the thickness) of a carriage of the printer, in other words, there is a demand that the ink-jet printer is constructed in such a way that an ink tank which accommodates ink is not installed on the carriage. To this end, the ink in the ink tank which is installed on a main body of the printer needs to be supplied, via an ink supply tube, to a printing head carried on the carriage.

In the thus constructed ink-jet printer which uses the ink supply tube for supplying the ink from the ink tank to the printing head, the air inevitably permeates through the tube and is consequently dissolved in the ink due to properties or characteristics of the material for constituting the tube. Accordingly, it is needed to provide a bubble accumulating or retaining chamber on the upstream side of the printing head to remove the bubbles.

As a technique to remove the bubbles in the ink-jet printer which uses the ink supply tube, there is known an arrangement as disclosed in JP-A-2000-103084 (FIG. 1, in particular), for instance. In this arrangement, a manifold (functioning as the bubble accumulating chamber) is provided above the printing head while an ink tank and a circulating pump are provided on a stationary-position side, and the circulating pump is driven to remove the bubbles.

In the arrangement disclosed in JP-A-2000-103084, however, the ink-jet printer inevitably tends to be large-sized and complicated since it is needed to provide a return tube through which the ink is returned from the circulating pump to the ink tank for circulation.

Further, there is known an arrangement as disclosed in JP-A-2002-240310 (FIG. 5, in particular), for instance, that the air generated as the bubbles in the ink supply tube is accumulated at an upper portion of the ink tank installed on the carriage and is discharged by a discharge pump. After the discharge of the air, the ink tank is fluid-tightly closed by a discharge valve.

The applicant of this application proposed an air-discharging device 303 shown in FIG. 18, in the ink-jet printer constructed as described above. In the proposed air-discharging device 303, a valve member 302 is arranged to be moved within an air-discharge hole 301 which has a large-diameter portion 301A and a small-diameter portion 301B communicating with each other through a communication opening 301C and which communicates with a bubble accumulating chamber (not shown) through an upper recessed discharge-passage portion 308, such that the valve member 302 is moved in an axis direction of the air-discharge hole 301, thereby permitting the bubbles accumulated in the bubble accumulating chamber to be discharged. In this arrangement, an O-ring 304 (as a sealing member) for opening and closing the communication opening 301C has an inside diameter smaller than an outside diameter of a rod portion 302*b* of the valve member 302, so that, when the valve member 302 is moved upwards, the O-ring 304 is moved upwards together with the rod portion 302*b*. Further, for increasing the sealing tightness, there is provided a coil spring 305 which biases a valve head 302*a* in a direction in which the communication opening 301C is closed.

In the proposed air-discharging device 303, the coil spring 305 is inserted at its upper end potion on a supporting protrusion 306 in which an air-inlet 307 is formed. In this arrangement, the air introduced from the air-inlet 307 flows to the outside of the coil spring 305 through adjacent portions of the wire of the same 305, and is consequently discharged through the communication opening 301C.

SUMMARY OF THE INVENTION

In the ink-jet printer having the thus constructed air-discharging device 303, in a case where the ink adheres between the O-ring 304 and a seat surface with which the O-ring 304 is in contact when the valve member 302 is in its closed state, the ink exhibits bonding property. In this instance, when the valve member 302 is moved upwards, the rod portion 302*b* is moved upwards whereas the O-ring 304 sticks to and remains on the seat surface. Because the inside diameter of the O-ring 304 (as the sealing member) is made smaller than the outside diameter of the rod portion 302*b* as described above, the valve member 302 cannot be placed in its open state, thus making it impossible to discharge the air. If the air is not discharged, the bubbles continue to be accumulated in the bubble accumulating chamber and consequently move to the printing head, disturbing a normal or proper printing operation.

Moreover, the air-discharging device 303 constructed as described above suffers from another problem. When the air is introduced through the air-inlet 307 for being discharged, the coil spring 305 is compressed, so that the pitch of the coil spring 305 is decreased, resulting in an increase in a resistance to the flow of the air passing between adjacent portions of the wire of the coil spring 305. Where the resistance to the flow of the air is increased, the air-purging operation is not performed while confirming whether or not the discharging of the air has been carried out, so that there are generated variations in the discharge amount of the air in every air-purging operation.

It is therefore an object of the present invention to provide an ink-jet printer which assures that the accumulated air can be discharged with high reliability.

The object indicated above may be achieved according to a principle of the present invention, which provides an ink-jet printer, comprising: a printing head for performing printing on a print medium by ejecting ink from nozzles; an ink tank for storing the ink to be supplied to the printing head; an ink passage through which the ink is supplied from the ink tank to the printing head; a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber and having: (A) a valve portion which opens and closes the communication opening and which includes a sealing member; and (B) a rod portion connected to the valve portion. The air-discharging device further includes air-discharge-flow assuring means for assuring a discharge flow of the air flowing from the buffer tank through the air-discharge passage.

In the present ink-jet printer constructed as described above, the air-discharge-flow assuring means assures, with high reliability, a discharge flow of the air from the buffer tank through the air-discharge passage. Therefore, the air accumulated in the buffer tank can be discharged, so that the ink-jet printer is capable of performing a reliable printing operation without adverse influence of the air.

In a first preferred form of the present invention, the air-discharge-flow assuring means is realized by a structure that the air-discharging device includes retaining means for retaining the sealing member on the rod portion such that the sealing member is movable together with the rod portion in a direction to open and close the communication opening.

According to the above-described first preferred form of the invention, the retaining means retains the sealing member on the rod portion, so that, when the valve member is operated to open the communication opening provided in the air-discharge passage, the sealing member is moved together with the rod portion as a unitary component in a direction to open the communication opening. Accordingly, when the valve member is placed in its open state, the communication opening is prevented from being kept closed by the sealing member, in other words, the communication opening can be opened with high reliability, permitting the air to be discharged therethrough.

In the above-indicated first preferred form, the valve portion which opens and closes the communication opening and which includes the sealing member comprises not only a valve portion arranged to close the communication opening via the sealing member, but also a valve portion arranged to close the communication opening such that the sealing member engages the peripheral edge of the communication opening. Described more specifically referring to FIG. 9, a valve portion 102*a* of a valve member 102 which is operable to open and close a communication opening 101 provided in the air-discharge passage may be constituted substantially only an annular sealing member 103 which is retained on one end portion of a rod portion 102*b*.

In a second preferred form of the present invention, the valve portion further includes a valve head connected to the rod portion and backing the sealing member which is held on the rod portion, and the air-discharge-flow assuring means is realized by a structure that the air-discharging device is configured to have at least one clearance between the rod portion and the sealing member, for permitting passing of the air between the valve head and the sealing member when the valve head and the sealing member are separated away from each other.

According to the above-described second preferred form of the invention, the at least one clearance is formed between the rod portion and the sealing member for permitting passing of the air between the valve head and the sealing member when the valve head and the sealing member are separated away from each other, whereby the air (the bubbles) accumulated in the buffer tank can be reliably discharged through the clearance when the air-discharging device is operated to discharge the air.

In a third preferred form of the present invention, the air-discharge passage has an air-inlet through which the air accumulated in the buffer tank is introduced into the valve chamber and an air-outlet from which the air introduced into the valve chamber is flowed out therefrom, one of the air-inlet and the air-outlet being the communication opening. The air-discharging device further includes a spring member which biases the valve portion in a direction to close said one of the air-inlet and the air-outlet. The air-discharge-flow assuring means is realized by a structure that an air-flow path from the air-inlet to the air-outlet is formed radially outwardly of the spring member which is disposed in a radially central portion of the valve chamber.

According to the above-described third preferred form, the air-flow path from the air-inlet to the air-outlet is formed radially outwardly of the spring member that is disposed in the radially central portion of the valve chamber, so that, even when the spring member is in a compressed state, there is caused the discharge flow of the air within the valve chamber from the air-inlet toward the air-outlet, without being influenced by the state of the spring member. Therefore, the present arrangement is effective to prevent the discharge amount of the air from being varied in every air-purging operation.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which:

FIGS. 8A-8C are views for explaining a valve member according to a modified embodiment of the first embodiment, in which FIG. 8C is a cross sectional view taken along line 7-7 in FIG. 8A;

FIGS. 11A and 11B are views for explaining a valve member according to the second embodiment, in which FIG. 11A is a front view partly in cross section and FIG. 11B is a bottom plan view;

FIGS. 12A and 12B are views for explaining the operation of the air-discharging device of FIG. 10, in which FIG. 12A shows a case wherein a sealing member is moved together with a valve head and FIG. 12B shows a case wherein the sealing member remains on a valve seat surface;

FIGS. 15A and 15B are views for explaining a valve member according to the third embodiment, in which FIG. 15A is a front view partly in cross section and FIG. 15B is a bottom plan view;

FIGS. 16A and 16B are views for explaining the operation of the air-discharging device of FIG. 14, in which FIG. 16A shows a case wherein a sealing member is moved together with a valve head and FIG. 16B shows a case wherein the sealing member remains on a valve seat surface;

DETAILED DESCRIPTION OF THE PREFERRED EMBODIMENTS

There will be described in detail preferred embodiments of the present invention by reference to the accompanying drawings.

Figure 1:
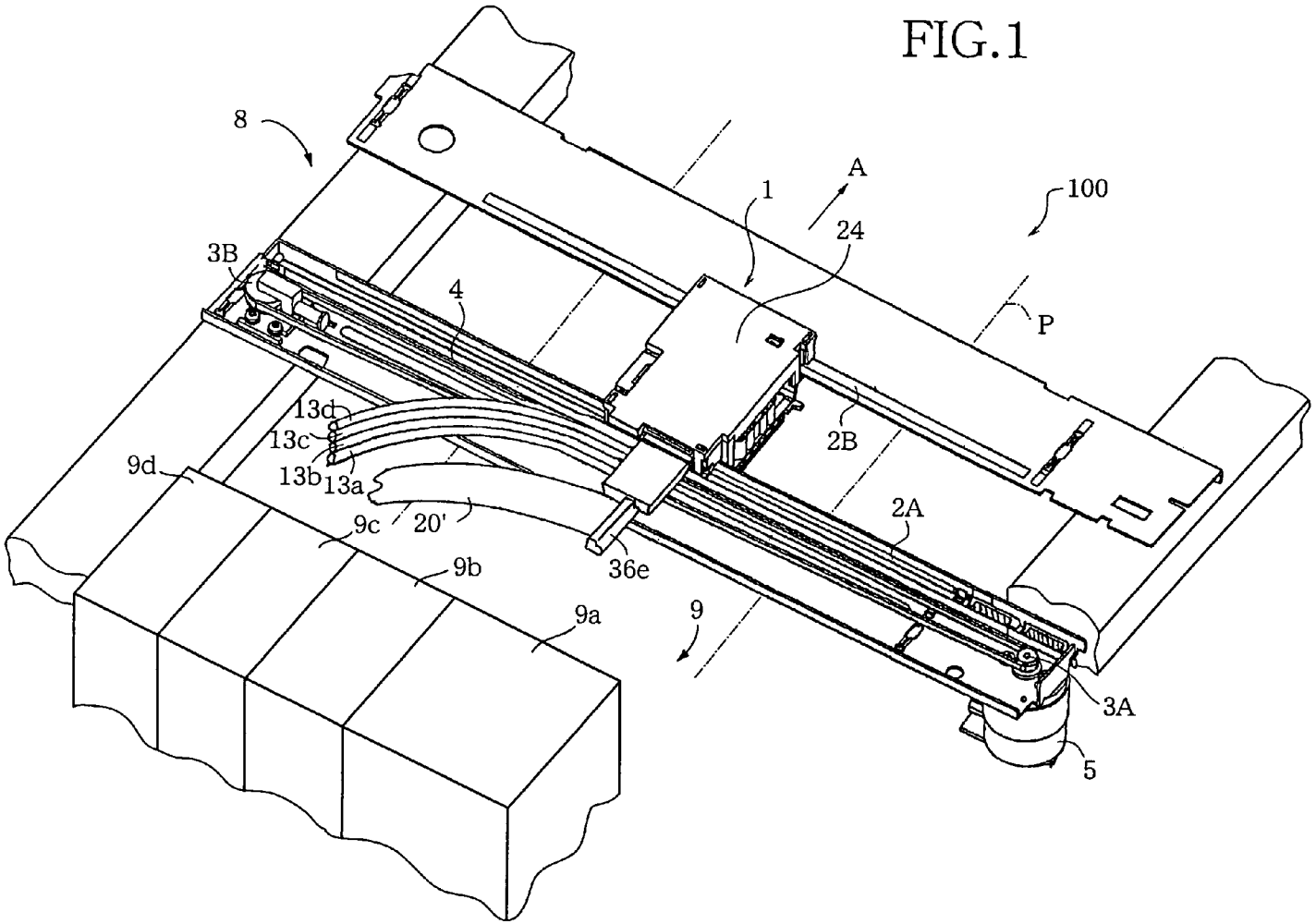
FIG. 1 is a schematic view showing principal parts of an ink-jet printer to which the principle of the present invention is applied.
Figure 2:
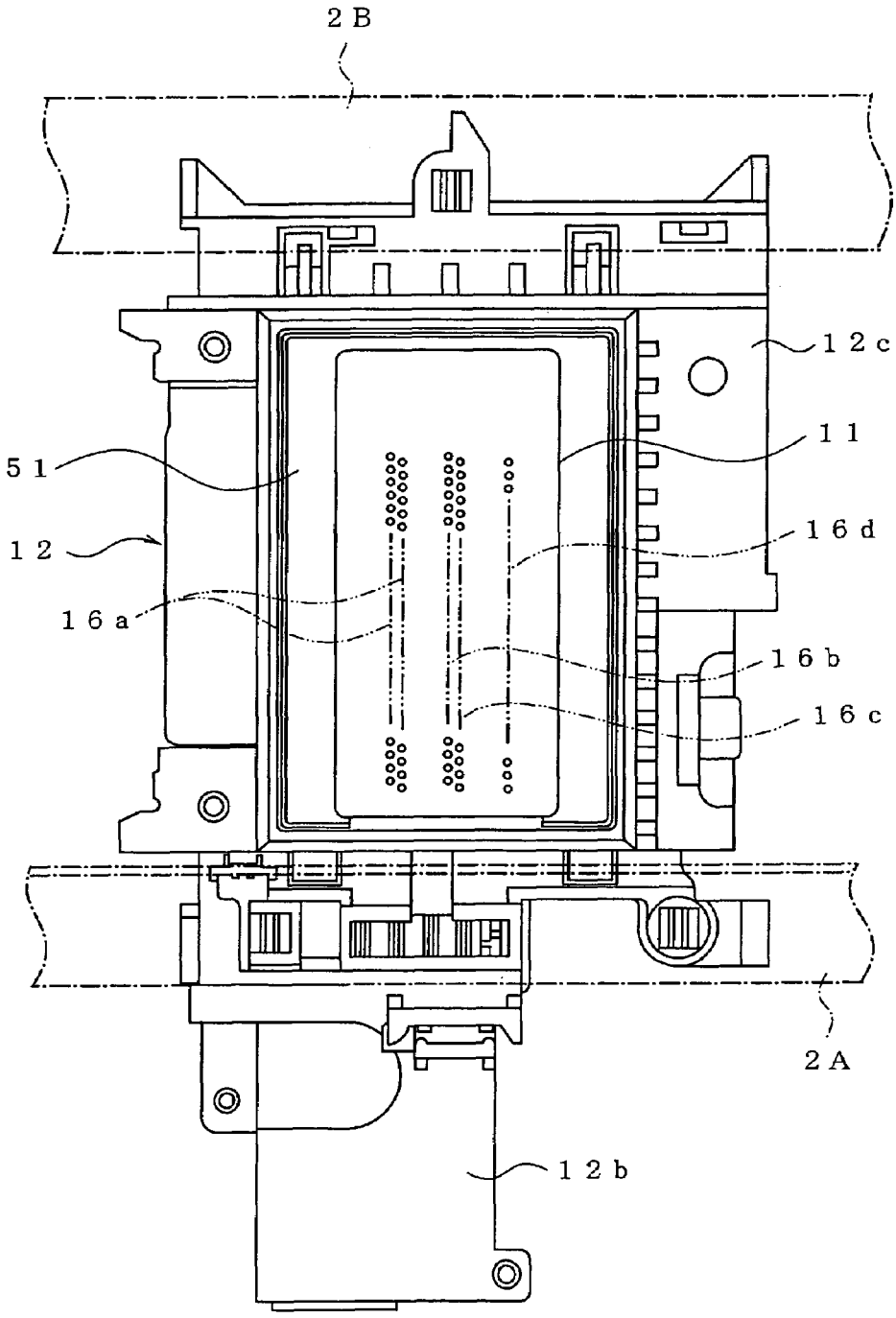
FIG. 2 is a bottom plan view of an ink-jet printing unit of the printer of FIG. 1.
Figure 3:
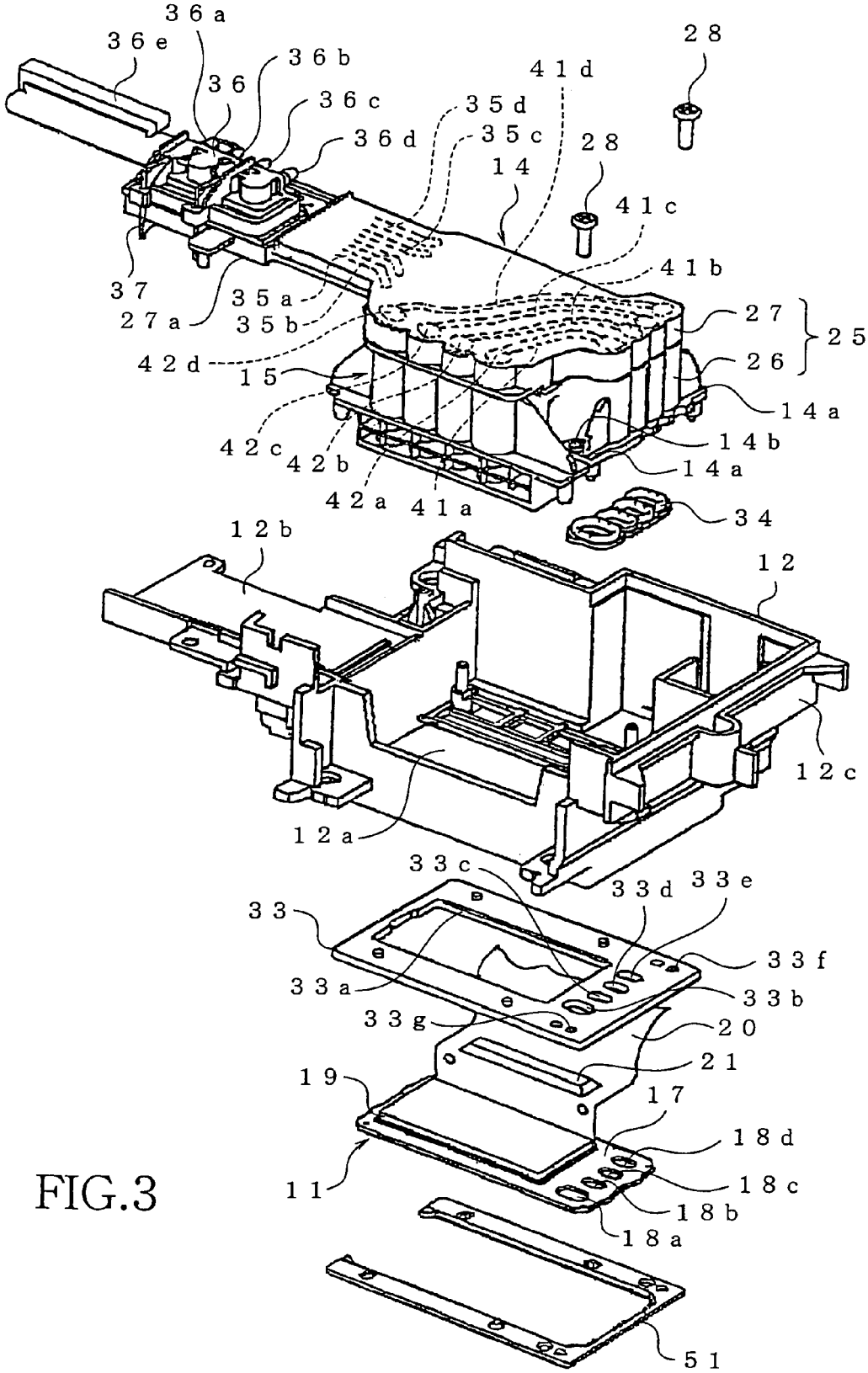
FIG. 3 is an exploded perspective view of the ink-jet printing unit including a printing head, a reinforcement frame member, a head holder, and a buffer tank.

FIG. 1 is a schematic view showing principal parts of an ink-jet printer 100 to which the principle of the present invention is applied. FIG. 2 is a bottom plan view of an ink-jet printing unit 1 of the printer 100. FIG. 3 is an exploded perspective view of the ink-jet printing unit 1 which includes a printing head 11, a reinforcement frame member 33, a head holder 12, and a buffer tank 14.

As shown in FIGS. 1-3, the ink-jet printer 100 includes the ink-jet printing unit 1 having a thin plate-stacked printing head 11 of an ink-jet type for ejecting inks from nozzle holes, and a head holder 12 on which the printing head 11 is mounted and which is formed of a synthetic resin material. The ink-jet printer 100 further includes an ink tank 9. Described more specifically, the ink tank 9 includes a plurality of ink tanks 9*a*-9*d* respectively for a black ink, a cyan ink, a magenta ink, and a yellow ink, which are provided a frame 8 (a part of which is shown in FIG. 1) of the printer for full-color printing. The head holder 12 functions as a carriage which moves relative to a paper sheet P (as a print medium). In the present ink-jet printer 100, the inks are supplied from the respective ink tanks 9*a*-9*d* via respective ink supply tubes 13*a*-13*d* (as a part of ink passages) to the buffer tank 14 mounted on the head holder 12 and temporarily stored therein. The buffer tank 14 will be described in greater detail. The air included in the inks which have been supplied from the ink tanks 9*a*-9*d* is dischargeably separated in the buffer tank 14, and the inks from which the air is separated are supplied to the printing head 11 in accordance with consumption by ejection. The ink tanks 9*a*-9*d* are removably attached to the frame 8 of the printer (hereinafter may be referred to as "the printer frame 8") and store a large volume of the inks to be supplied to the printing head 11.

The head holder 12 is slidably supported by a rear guide member 2A and a front guide member 2B which are parallel to each other in a frontward and backward direction of the frame 8 of the printer 100 and which extend in a leftward and rightward direction of the frame 8. The rear guide member 2A has a generally "L"-shape in cross section in a plane perpendicular to a sliding or moving direction of the head holder 12 in which the head holder 12 slides or moves. The front guide member 2B has a horizontal plane extending in the sliding direction. The head holder 12 is connected to a portion of an endless timing belt 4 stretched between a drive pulley 3A and a driven pulley 3B. By driving the drive pulley 3A by a drive motor 5, the head holder 12 is arranged to be reciprocated in the leftward and rightward direction of the frame 8 via the timing belt 4 along the rear and front guide members 2A, 2B. The upper portion of the head holder 12 is covered with a cover 24. Although not specifically shown, a known sheet feeding mechanism is provided to feed the paper sheet P in a direction (indicated by an arrow "A" in FIG. 1) perpendicular to the moving direction of the head holder 12, such that the paper sheet P faces the lower surface of the printing head 11 in a state in which printing can be performed on the paper sheet P. There are also provided a maintenance unit 70 (which will be described in greater detail) which performs a cleaning operation for cleaning the surface of the printing head 11 in which the nozzle holes are formed, a restoring treatment in which a selected one or ones of different colors of inks is/are sucked, and a bubble (air) removal treatment for removing bubbles (air) accumulated in the buffer tank 14, and an ink-receiving portion which receives inks ejected from the printing head 11 in a flushing operation periodically performed during the printing operation for preventing clogging of the nozzle holes.

As shown in FIG. 2 indicating the lower or bottom surface of the printing head 11, there are formed, in the lower surface of the printing head 11, two rows of black-ink (BK) nozzle holes 16*a*, a row of cyan-ink (C) nozzle holes 16*b*, a row of a yellow-ink (Y) nozzle holes 16*c*, and a row of the magenta-ink (M) nozzle holes 16*d*, which rows are arranged in order from the left to the right as seen in the bottom plan view of the printing head 11 of FIG. 2. These rows of the nozzle holes 16*a*-16*d* extend in a direction perpendicular to the moving direction of the head holder 12 (i.e., perpendicular to a primary scanning direction). The nozzle holes 16*a*-16*d* are formed in the lower surface of the printing head 11 so as to be open downwardly, such that the nozzle holes 16*a*-16*d* are opposed to the upper surface of the paper sheet P on which printing is performed.

As shown in FIG. 3, at one of longitudinally opposite ends of the printing head 11, four ink supply holes 18*a*-18*d* of a cavity unit 17 respectively for the inks of our different colors are formed in a row so as to be open in the upper surface of the printing head 11. The inks are distributed via respective ink supply channels extending from the respective ink supply holes 18*a*-18*d*, and are ejected from the nozzle holes 16*a*-16*d* by driving a piezoelectric actuator 19. The area of opening of the ink supply hole 18*a* for the black ink (BK) is made larger than that of the other ink supply holes 18*b*-18*d* for the cyan ink (C), the yellow ink (Y), and the magenta ink (M), respectively.

In the printing head 11, the piezoelectric actuator 19 has an outer contour in its plan view which is smaller than that of the cavity unit 17, so that, when the piezoelectric actuator 19 is superposed or stacked on the upper surface of the cavity unit 17, the peripheral portion of the upper surface of the cavity unit 17 which surrounds the piezoelectric actuator 19 and in a part of which the ink supply holes 18*a*-18*d* are formed is exposed on the upper surface of the printing head 11.

On the upper surface of the piezoelectric actuator 19, a flexible flat cable 20 is fixed at its proximal portion for applying a voltage to the piezoelectric actuator 19. The flexible flat cable 20 has a driver IC 21 and is electrically connected to a printed board 22 (FIG. 5) disposed on the buffer tank 14. The printed board 22 is arranged to be connected to a printed board (not shown) of a main body on the side of the printer frame 8 of the ink-jet printer 100 via another flexible flat cable 20'. Because the driver IC 21 generates a heat, a heat sink 23 formed of an aluminum alloy is disposed so as to be held in pressing contact with the driver IC 21 as shown in FIG. 6 for cooling the same 21, so that the driver IC 21 is spontaneously cooled down through the heat sink 23.

Figure 4:
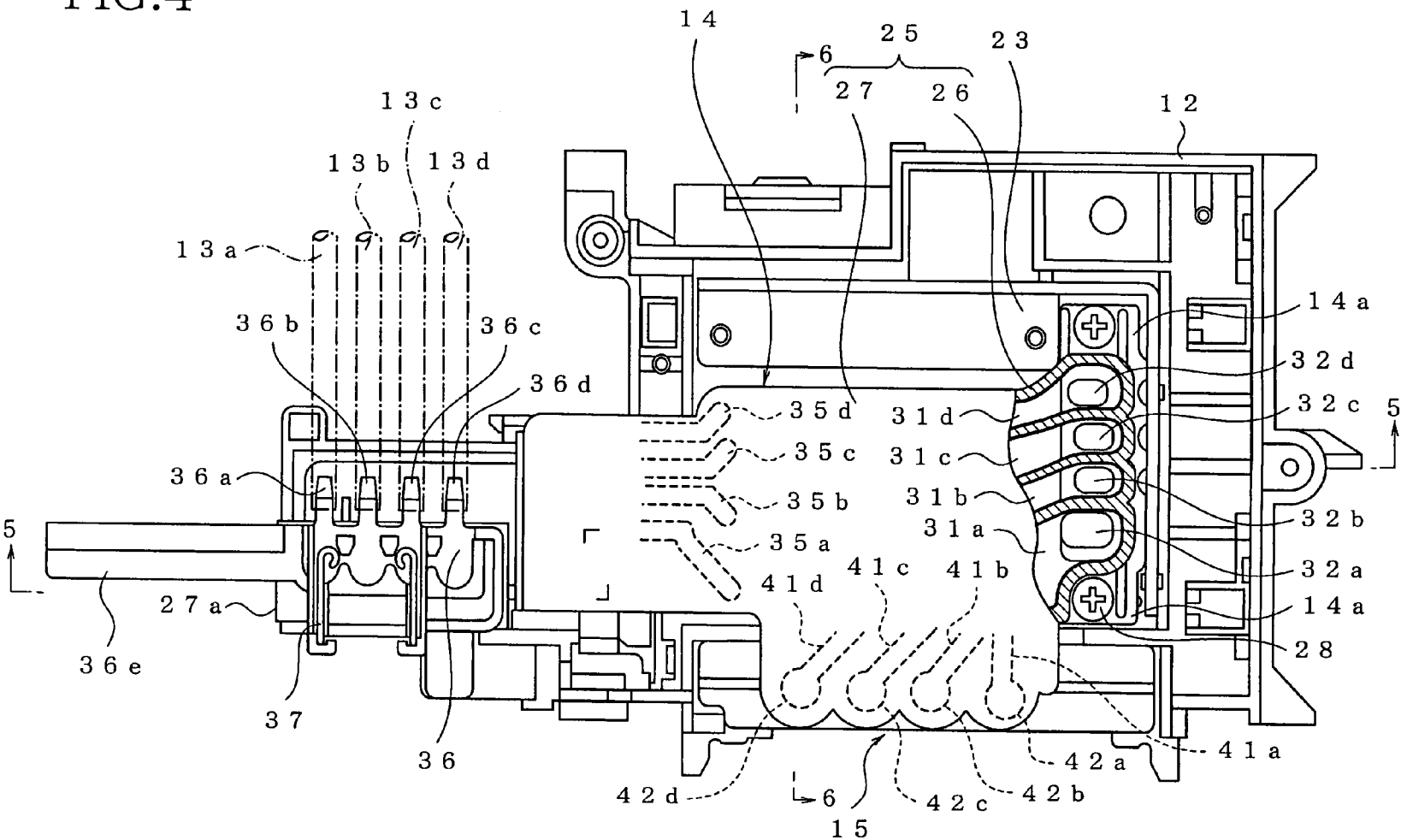
FIG. 4 is a plan view partly in cross section showing the ink-jet printing unit of FIG. 2.
Figure 5:
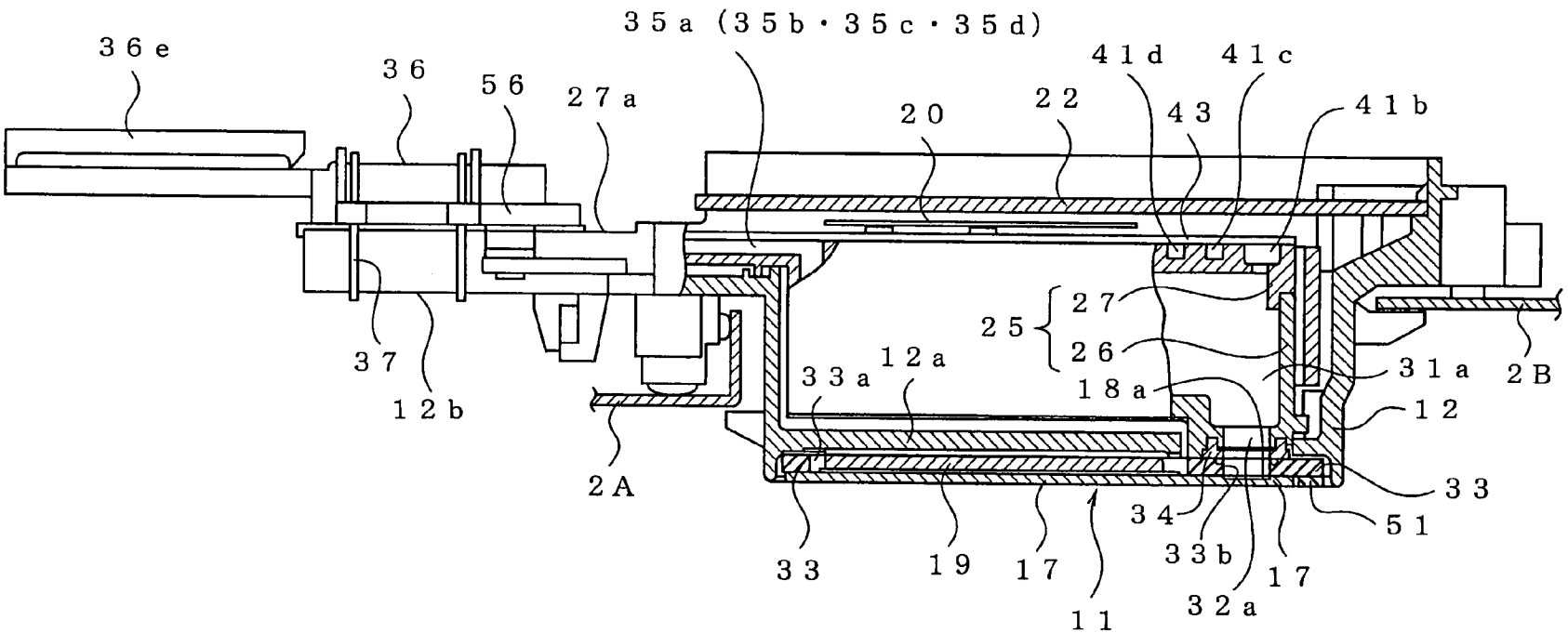
FIG. 5 is a cross sectional view taken along line 5-5 in FIG. 4.
Figure 6:
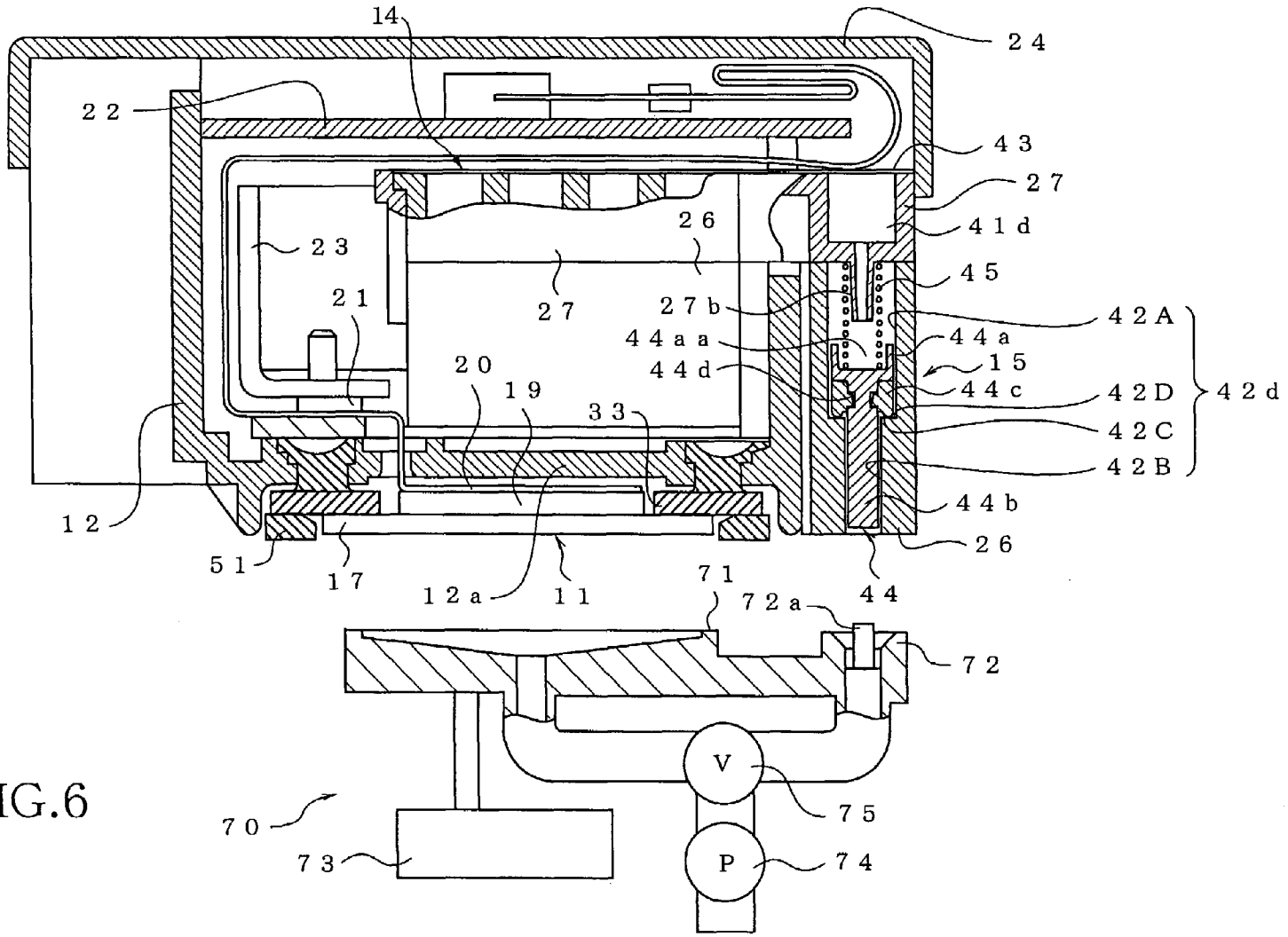
FIG. 6 is a cross sectional view taken along line 6-6 in FIG. 4 and for explaining an air-discharging device according to a first embodiment of the invention.

As shown in FIGS. 4-6, there are provided, in the buffer tank 14, a plurality of mutually independent bubble accumulating chambers for the respective inks of different colors, which chambers are formed by providing partition walls in an inside space of a casing 25. More specifically described, the plurality of bubble accumulating chambers consist of four bubble accumulating chambers 31*a*-31*d* respectively for the black ink (BK), the cyan ink (C), the yellow ink (Y), and the magenta ink (M).

The casing 25 in which the buffer tank 14 is formed is constituted by a box-like lower casing member 26 having an upper opening, and an upper casing member 27 which is fixed to the lower casing member 26 so as to close the upper opening of the lower casing member 26. The lower and upper casing members 26, 27 are both formed by injection molding of a synthetic resin material and fluid-tightly fixed to each other by ultrasonic welding, for instance. The thus fixed lower and upper casing members 26, 27 define: ink-tank chambers (not shown) for temporarily accommodating the respective inks of the different colors on the side of the lower casing member 26; and the above-described bubble accumulating chambers 31*a*-31*d* for accumulating the air separated from the inks on the side of the upper casing member 27. Each bubble accumulating chamber 31*a*-31*d* may be given by a single space or a plurality of divided spaces. Each of the bubble accumulating chambers 31*a*-31*d* communicates at one end thereof with a corresponding one of ink outlets 32*a*-32*d* for the respective inks.

The head holder 12 has a bottom plate portion 12*a* which is generally parallel to the upper surface of the printing head 11. The printing head 11 is bonded to the lower surface of the bottom plate portion 12*a* with the reinforcement frame member 33 interposed therebetween. The reinforcement frame member 33 will be described. As shown in FIG. 3, on the upper side of the bottom plate portion 12*a* of the head holder 12, there is disposed the casing 25 which includes the buffer tank 14 for temporarily storing the inks therein and an air-discharging device 15 for discharging the bubbles (the air) accumulated in the bubble accumulating chambers 31*a*-31*d* of the buffer tank 14.

The ink outlets 32*a*-32*d* are arranged in a row on the lower surface of the lower casing member 26 so as to be open downwardly and located at a height position lower than that of the bottom plate portion 12*a* of the head holder 12. The cavity unit 17 (the printing head 11) includes, on the upper surface thereof, the plurality of ink supply holes 18*a*-18*d* each communicating with one end of a corresponding one of the ink supply channels (manifolds) formed in the inside of the cavity unit 17 for the respective inks of the different colors, such that the ink supply holes 18*a*-18*d* correspond respectively to the ink outlets 32*a*-32*d*. The ink outlets 32*a*-32*d* are held in communication with the respective ink supply holes 18*a*-18*d* of the cavity unit 17 (the printing head 11) through respective ink passage holes 33*b*-33*e* formed in a row through the reinforcement frame member 33, via an elastic sealing member 34 such as a rubber packing.

The printing head 11 is fixed to the lower side of the head holder 12 with the reinforcement frame member 33 interposed therebetween. As shown in FIG. 3, the reinforcement frame member 33 has a flat plate-like member along the upper surface of the printing head 11 and has a central opening 33*a* whose size in its plan view is slightly larger than that of the outer contour of the piezoelectric actuator 19 and smaller than that of the outer contour of the cavity unit 17. Accordingly, the reinforcement frame member 33 is bonded and fixed to the upper surface of the cavity unit 17 such that the piezoelectric actuator 19 and the flexible flat cable 20 are positioned or fitted in the central opening 33*a*.

The reinforcement frame member 33 is formed of a metal such as SUS430 and has a thickness and a rigidity which are larger and higher than those of the cavity unit 17. As described above, the reinforcement frame member 33 has, at its longitudinal end corresponding to the ink supply holes 18*a*-18*d* of the cavity unit 17, the four ink passage holes 33*b*-33*e* formed therethrough in a row for connecting the ink outlets 32*a*-32*d* of the buffer tank 14 and the ink supply holes 18*a*-18*d* of the cavity unit 17.

To compensate for a difference in height positions between the lower surface of the printing head 11 and the reinforcement frame member 33 and to protect the printing head 11, a protective cover 51 having a generally U-shape in its plan view is attached to the reinforcement frame member 33 so as to surround the periphery of the printing head 11.

As shown in FIG. 3, the reinforcement frame member 33 has tapped or threaded holes 33*f*, 33*g* formed at two corner portions thereof. The buffer tank 14 is provided with flange-like fixing portions 14*a* which protrude outwardly from its periphery so as to correspond to the tapped holes 33*f*, 33*g*. The fixing portions 14*a* are formed with through-holes 14*b*. Two screws 28 each as a fastening member are respectively screwed into the tapped holes 33*f*, 33*g* via the through-holes 14*b*, whereby the buffer tank 14 is fixed to the reinforcement frame member 33 which is bonded and fixed to the lower surface of the bottom plate portion 12*a* of the head holder 12.

On one of opposite ends of the upper casing member 27 of the casing 25 remote from the ink outlets 32*a*-32*d*, there is provided a flange-like extended portion 27*a* which extends therefrom and in which are formed mutually independent four ink-inlet passages 35*a*-35*d* respectively for the black ink (BK), the cyan ink (C), the yellow ink (Y), and the magenta ink (M), as shown in FIGS. 3 and 4. The downstream ends of the respective ink-inlet passages 35*a*-35*d* are held in communication with the respective bubble accumulating chambers 31*a*-31*d* via the respective ink-tank chambers (not shown) formed in the lower casing member 26. On the lower side of the extended portion 27*a* of the upper casing member 27, an extended portion 12*b* of the head holder 12 is formed so as to correspond to the extended portion 27*a*. The extended portion 12*b* of the head holder 12 extends from an upper end of a box-like main body 12*c* of the head holder 12 in which the buffer tank 14 is accommodated, so as to correspond to the extended portion 27*a* of the upper casing 27. To the leading ends of the extended portions 12*b*, 27*a*, a tube joint 36 having ink passes for the respective inks of the different colors is elastically attached by a spring 37. Thus, the ink-inlet passages 35*a*-35*d* communicate at upstream ends thereof with the respective ink passes within the tube joint 36.

The tube joint 36 has tube-connecting portions 36*a*-36*d* communicating with the respective ink passes within the same 36. To each of the tube-connecting portions 36*a*-36*d* of the tube joint 36, each of the ink supply tubes 13*a*-13*d* is removably connected at one end thereof opposite to the other end communicating with the corresponding ink tank (9*a*-9*d*) provided on the main body of the printer 100. The tube joint 36 has an integrally formed holding portion 36*e* for holding the flexible flat cable 20' which connects the printed board 22 to the printed board of the main body of the printer 100.

On the upper surface of the upper casing member 27, there are formed mutually independent four upper recessed discharge-passage portions 41*a*-41*d* for the respective inks of the four different colors. Each of the upper recessed discharge-passage portions 41*a*-41*d* is in the form of a recess and communicates at one end thereof with an upper space of the corresponding bubble accumulating chamber 31*a*-31*d*. Each upper recessed discharge-passage portion 41*a*-41*d* extends along the upper surface of the upper casing member 27 and communicates at the other end thereof with an upper end of a corresponding one of air-discharge holes 42*a*-42*d* formed through the lower casing member 26 and provided for the respective four inks. The upper openings of the upper recessed discharge-passage portions 41*a*-41*d* are covered with a flexible film 43.

Referring next to FIGS. 6-9, there will be next explained in detail the air-discharging devices 15, constructed according to a first embodiment of the invention, for discharging the bubbles (the air) accumulated in the bubble accumulating chambers 31*a*-31*d* of the buffer tank 14.

The four air-discharge holes 42*a*-42*d* formed on one side of the lower casing member 26 for the respective four inks extend in the vertical direction of the same 26 and are open at opposite ends thereof. As shown in FIG. 6, each air-discharge hole has an upper large-diameter portion and a lower small-diameter portion which communicate with each other via a communication opening. (In FIG. 6, while there is shown only the air-discharge hole 42*d* having the large-diameter portion 42A and the small-diameter portion 42B which communicate with each other via the communication opening 42C, the air-discharge holes 42*a*-42*c* have a structure similar to that of the air-discharge hole 42*d*.) Each air-discharge hole, in detail, the large-diameter portion of each air-discharge hole functions as a valve chamber in which a valve member 44 (which will be described) slides. In this embodiment, an air-discharge passage is constituted by including the air-discharge hole 42*d*.

The valve member 44 includes a valve portion and a rod portion 44*b*. The valve portion has a valve head 44*a* and a ring-like sealing member 44*c* which is inserted on the rod portion 44*b* and whose outside diameter is substantially equal to that of the valve head 44*a*. The rod portion 44*b* is connected to a lower end of the valve head.

Figure 7A:
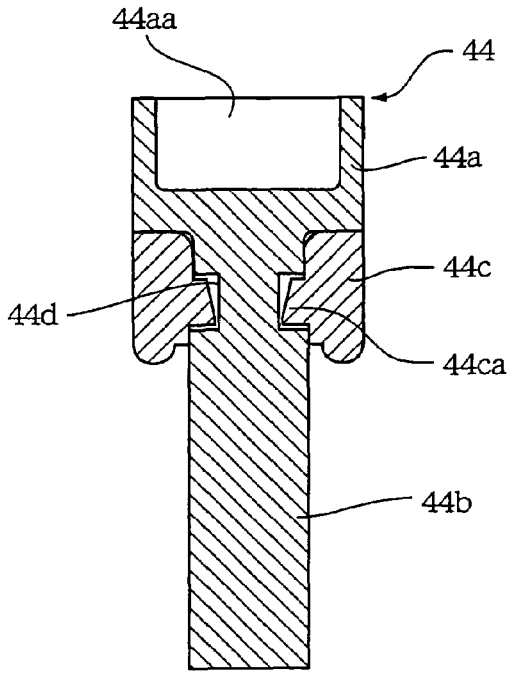
FIGS. 7A and 7B are views for explaining a valve member according to the first embodiment.
Figure 7B:
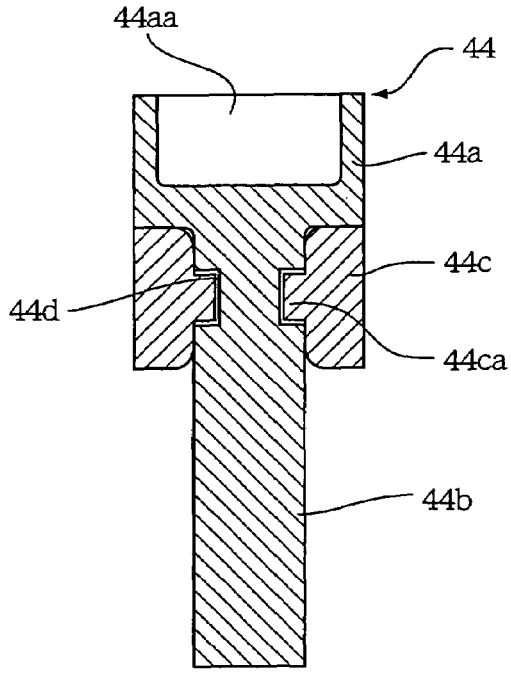

As shown in FIG. 7, the valve head 44*a* has an outside diameter larger than that of the rod portion 44*b*. In the vicinity of a connecting portion of the rod portion 44*b* at which the rod portion 44*b* is connected to the valve head 44*a*, there is formed, around the entire periphery of the rod portion 44*b*, a recessed retaining portion 44*d* in the form of a concave portion functioning as retaining means. The recessed retaining portion 44*d* retains the sealing member 44*c* thereon such that the sealing member 44*c* is movable together with the rod portion 44*b* in a direction to open and close the communication opening 42C. The sealing member 44*c* has a protrusion 44*ca* formed integrally at its inner circumferential portion that defines a central hole thereof. The sealing member 44*c* is an annular or a ring-like member inserted or fitted on the rod portion 44*b* and is suitably provided by a packing of a rubber elastic body, for instance. With the protrusion 44*ca* of the sealing member 44*c* being retained on the rod portion 44*b* at its recessed retaining portion 44*d*, the sealing member 44*c* is in elastic contact at an upper end thereof with the valve head 44*a*. The valve head 44*a* is opposed, via the sealing member 44*c*, to a stepped surface 42D of the air-discharge hole 42*d* which is located around the periphery of the communication opening 42C. This stepped surface 42D functions as a valve seat surface with which the valve head 44*a* is in contact via the sealing member 44*c*. The stepped surface 42D may be hereinafter referred to as "the valve seat surface 42D". For avoiding inappropriate or erroneous assembling of the sealing member 44*c* onto the valve member 44, the sealing member 44*c* may be configured to be symmetrical in a direction of thickness or height thereof, not only in its main portion, but also in the protrusion 44*c*, as shown in FIG. 7B.

The large-diameter valve head 44*a* is inserted in the large-diameter portion 42A of the air-discharge hole 42*d* with spacing being left therebetween for permitting the air (gas) to flow therethrough and the rod portion 44*b* is inserted in the small-diameter portion 42B with spacing being left therebetween for permitting the air (gas) to pass therethrough, so that the valve member 44 is slidably supported within the air-discharge hole 42*d* in its center axis direction. The upper open end of the small-diameter portion 42B functions as the communication opening 42C which permits the bubble accumulating chamber 31*d* to communicate with the atmosphere via the upper recessed discharge-passage portion 41*d*, and the communication opening 42C is opened and closed by the large-diameter valve head 44*a* via the sealing member 44*c*. In other words, the bottom surface of the large-diameter portion 42A functions as the valve seat surface 42D, and the sealing member 44*c* is disposed between the valve seat surface 42D and the valve head 44*a*.

As shown in FIG. 6, the air-discharging device 15 includes a coil spring 45 (as a spring member) which is inserted in the large-diameter portion 42A and which functions as biasing means for biasing the valve member 44 (the valve head 44*a*) in a direction to close the communication opening 42C. The upper end portion of the coil spring 45 is fitted or inserted on a supporting protrusion 27*b* of the upper casing member 27 while the lower end portion thereof is inserted in an upper recess 44*aa* of the valve head 44*a*. The coil spring 45 biases the valve head 44*a* in a direction in which the sealing member 44*c* is held in abutting contact with the valve seat surface 42D.

As described above, the valve member 44 (the valve head 44*a*) is constantly pressed or biased by the coil spring 45 in a downward direction, i.e., in the direction in which the sealing member 44*c* is held in abutting contact with the valve seat surface 42D. Thus, when the sealing member 44*c* is pressed and held by and between the valve head 44*a* and the valve seat surface 42D, the valve member 44 is in its closed state in which the communication opening 42C is closed. (Hereinafter, this state may be referred to simply as "the valve-close state".) On the other hand, when the rod portion 44*b* is pushed up by a projecting shaft portion 72*a* (as a rod-portion-pushing member) of a second cap portion 72 of a maintenance unit 70 as described below in detail and accordingly the sealing member 44*c* is moved upwards together with the rod portion 44*b* so as to be separated away from the valve seat surface 42D, the valve member 44 is placed in its open state in which the communication opening 42C is opened. (Hereinafter, this state may be referred to simply as "the valve-open state".) When the valve member 44 is in its open state, there is formed spacing between the valve seat surface 42D and the sealing member 44*c*, so that the bubbles in the bubble accumulating chamber 31*d* can be discharged from the communication opening 42C via the small-diameter portion 42B and a suction pump 74 (which will be described). For placing the valve member 44 in its open state, the rod portion 44*b* needs to be pushed up by the projecting shaft portion 72*a* of the maintenance unit 70 as explained above. Accordingly, the lower end portion of the rod portion 44*b* inserted in the small-diameter portion 42B reaches in the vicinity of the lower open end of the small-diameter portion 42B in the valve-closed state.

As described above, the maintenance unit 70 performs: the cleaning operation for cleaning the surface of the printing head 11 in which the nozzle holes are formed; the restoring treatment in which a selected one or ones of different colors of inks is/are sucked; and the bubble (air) removal treatment for removing the bubbles (the air) accumulated in the buffer tank 14. The maintenance unit 70 includes a first cap portion 71 which is operable to cover the nozzle opening surface of the printing head 11 so as to cover all nozzle holes 16*a*-16*d*, and a plurality of second cap portions 72 which are operable to cover the lower end surface of the air-discharging device 15, namely, to respectively cover the lower open ends of the respective small-diameter portions 42B. The first and second cap portions 71, 72 are vertically movably supported by a vertically moving mechanism 73 whose structure is similar to that of a known maintenance unit. When the head holder 12 as the carriage is at its home position where the printing operation is not performed, the first and second cap portions 71, 72 are elevated so as to be held in close contact with the nozzle opening surface of the printing head 11 and the lower end surface of the air-discharging device 15, for covering the openings of the nozzles 16*a*-16*d* and the lower open ends of the small-diameter portions 42B. When the carriage is not at its home position, the first and second cap portions 71, 72 are lowered by the vertically moving mechanism 73 so as to be separated away from those surfaces. The first cap portion 71 is connected to the suction pump 74 as in the known maintenance unit, so that thickened or viscosity-increased ink and foreign matter are sucked by actuating the suction pump 74, so as to be removed from the nozzles 16*a*-16*d*.

Each second cap portion 72 has the projecting shaft portion 72*a* projecting upwardly from the main body of the same 72. When the projecting shaft portions 72*a* of the second cap portion 72*a* are brought into close contact with lower end surface of the air-discharging device 15, the projecting shaft portions 72*a* push up the valve members 44 against the biasing force of the coil springs 45, so that the sealing members 44*c* are separated away from the respective valve seat surfaces (42D), namely, away from the bottom surfaces of the large-diameter portions (42A), whereby the valve members 44 are placed in their open states.

The second cap portions 72 are connected to the suction pump 74 via a common flow passage, and the bubbles (the air) accumulated in the bubble accumulating chambers 31*a*-31*d* of the buffer tank 14 can be concurrently sucked and discharged by driving the suction pump 74. In this arrangement, the inks supplied from the respective ink tanks 9*a*-9*d* to the printing head 11 via the respective ink supply tubes 13*a*-13*d* are temporarily stored in the bubble accumulating chambers 31*a*-31*d* provided in the route of flow of each ink, and the bubbles contained in the inks are separated from the inks and floated on the inks. The thus separated bubbles (air) are accumulated at the upper portions of the bubble accumulating chambers 31*a*-31*d*, and are consequently sucked and discharged by the suction pump 74 as explained above.

The first cap portion 71 and the second cap portions 72 is/are selectively connected to the suction pump 74 by a selector valve 75. The first and second cap portions 71, 72 are moved by the vertically moving mechanism 73 so as to be concurrently brought into close contact with the nozzle opening surface of the printing head 11 and the lower end surface of the air-discharging device 15. Preferably, the bubbles accumulated at the upper portions of the bubble accumulating chambers 31*a*-31*d* are initially discharged via the second cap portions 72, and thereafter the poor-quality inks are discharged form the nozzles 16*a*-16*d* via the first cap portion 71. If the bubbles accumulated in the bubble accumulating chambers 31*a*-31*d* are intended to be discharged only through the first cap portion 71, it is inevitable that considerably large amounts of inks are discharged. In the present arrangement, however, the discharging of the bubbles and the restoring treatment of the printing head 11 can be carried out while making the amounts of the inks to be discharged small.

The operation of sucking the inks from the nozzles 16*a*-16*d* and the operation of discharging the bubbles from the bubble accumulating chambers 31*a*-31*d* may be carried out independently of each other. In place of the sucking operation by the suction pump 74, it is possible to suck and remove the viscosity-increased or thickened ink and the foreign matter from the nozzles 16*a*-16*d* and discharge the bubbles in the bubble accumulating chambers 31*a*-31*d*, by applying positive pressure to the inks in the ink tanks 9*a*-9*d*. It is also possible to employ the sucking operation by the suction pump 74 and the application of the positive pressure in combination.

While, in the illustrated first embodiment, the sealing member 44*c* is simply retained on the rod portion 44*b*, there may be provided, between the rod portion and the sealing member, rotation preventive means for preventing the rod portion and the sealing member from rotating relative to each other. As the rotation preventive means, it is considered that the cross sectional shape of the rod portion on which the sealing member is inserted is suitably configured. More specifically described, the rotation preventive means is realized by a structure that the rod portion has, at a portion thereof on which the sealing member is inserted, a non-circular shape in cross section, e.g., a rectangular shape in cross section, for preventing the sealing member from easily rotating. Where the sealing member is retained on the rod portion at its recessed retaining portion as explained above, there may be employed, for instance, an arrangement shown in FIGS. 8A-8C as a modified embodiment of the illustrated first embodiment, in which the rotation preventive means is employed.

Figure 8A:
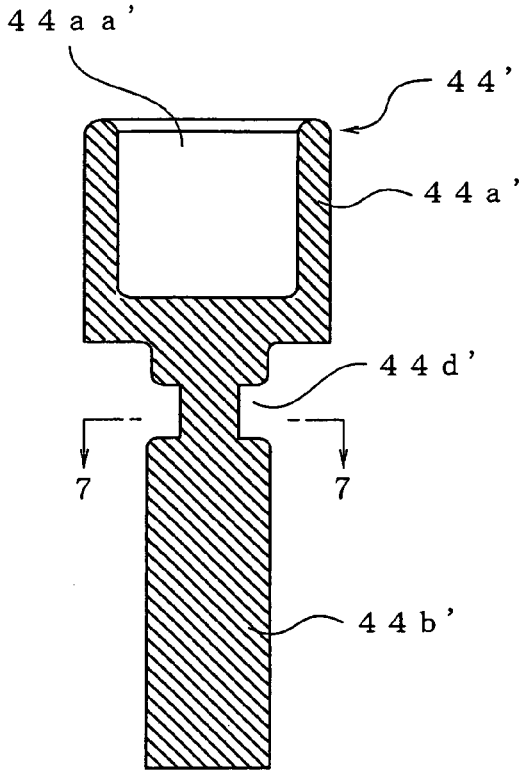
Figure 8B:
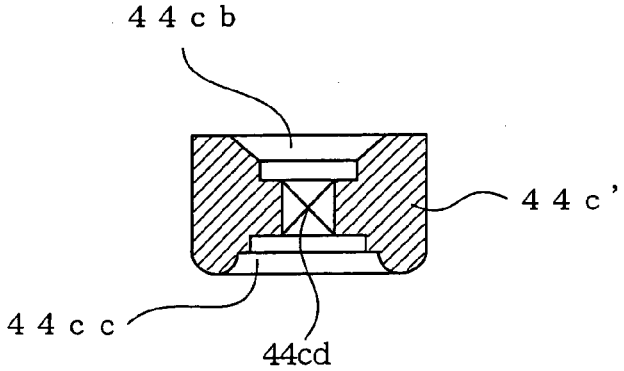
Figure 8C:
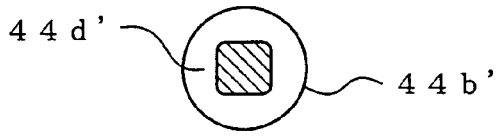
Figure 9:
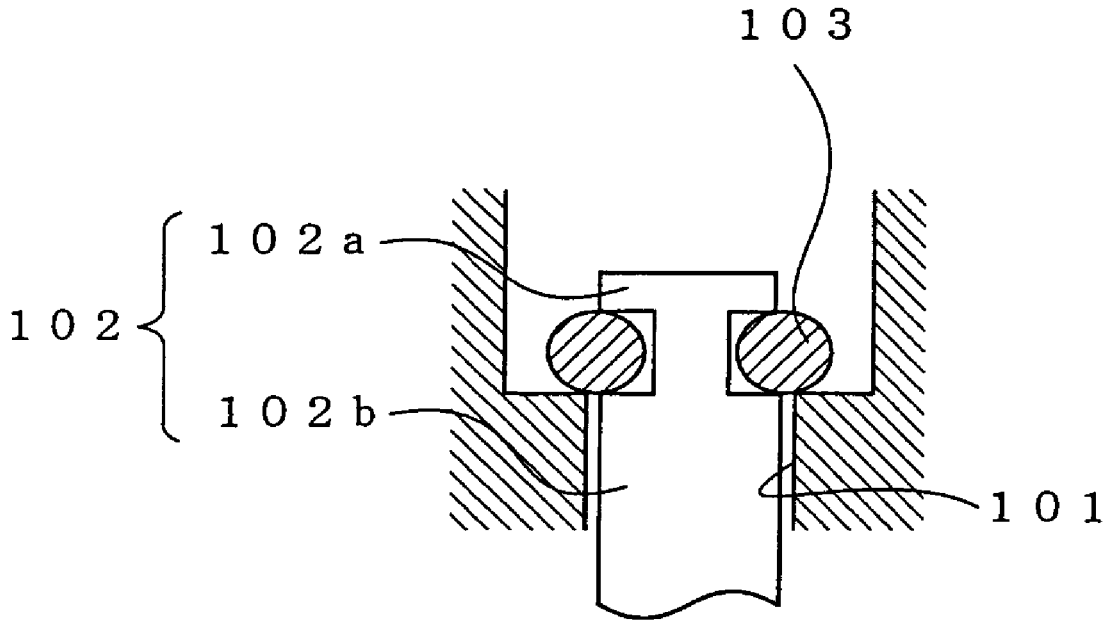
FIG. 9 is a view for explaining another valve member.

In the modified embodiment shown in FIGS. 8A-8C, a valve member 44' has: a valve portion including a valve head 44*a*' and a sealing member 44*c*'; and a rod portion 44*b*' on which the sealing member 44*c*' is inserted. A portion of the rod portion 44*b*' in the vicinity of the valve head 44*a*' is formed into a recessed retaining portion 44*d*' (as the concave portion) which has a rectangular cross sectional shape. The sealing member 44*c*' has a central hole 44*cd* having a rectangular cross sectional shape that corresponds to the rectangular cross sectional shape of the recessed retaining portion 44*d*' of the rod portion 44*b*'. The sealing member 44*c*' has an upper and a lower guide-hole portion 44*cb*, 44*cc* which are located at axially opposite ends of the central hole 44*cd* and which have respective diameters gradually increasing toward the axially outward directions of the sealing member 44*c*', for permitting the sealing member 44*c*' to be easily fitted in the recessed retaining portion 44*d*' of the rod portion 44*b*'. Depending upon the degree of flexibility of the sealing member 44*c*', the sealing member 44*c*' can be easily fitted in the recessed retaining portion 44*d*' having the rectangular cross sectional shape even where the sealing member 44*c*' is annular, and the recessed retaining portion 44*d*' having the rectangular cross sectional shape functions as the rotation preventive means for preventing rotation of the sealing member 44*c*' relative to the rod portion 44*b*'. It is noted that the recessed retaining portion 44*d*' may have any cross sectional shape, as long as the rotation of the sealing member can be restricted. It is preferable, for instance, that the recessed retaining portion 44*d*' has a polygonal cross sectional shape having a plurality of angular portions.

In the illustrated first embodiment and the modified embodiment thereof, even if the ink adheres between the sealing member 44, 44*c*' and the valve seat surface 42D with which the sealing member 44*c*, 44*c*' is held in contact in the valve-closed state, it is avoidable that only the rod portion 44*b*, 44*b*' is moved upwards while the sealing member 44*c*, 44*c*' remains on the valve seat surface 42D. Therefore, the bubbles (the air) in the bubble accumulating chambers 31*a*-31*d* can be discharged with high reliability by placing the valve member 44, 44' of the air-discharging device 15 in the open state. Accordingly, it is possible to avoid that the bubbles (the air) continue to accumulate in the bubble accumulating chambers 31*a*-31*d* and consequently move toward the printing head 11 to render proper printing operation impossible.

In the modified embodiment wherein the rotation preventive means is provided between the rod portion and the sealing member, the sealing member is prevented from rotating during operation of the valve member even where the sealing member inserted on the rod portion is annular or even where the sealing member has the central hole whose cross sectional shape is similar to that of the recessed retaining portion of the rod portion. Accordingly, the modified embodiment enjoys the following advantage, for instance: In forming the valve member, there are used a pair of molds which are butted together. Therefore, for forming, in the rod portion, the recessed retaining portion as the retaining means, it is inevitable that convex parting lines remain on the rod portion along parting surfaces of the pair of molds which are butted together. The sealing member may be pressed and concaved by the parting lines during its use and may not be restored to its original shape. Where the sealing member in such a state is rotated, there remain spaces between the sealing member and the rod portion due to the pressed or concaved portions of the sealing member corresponding to the parting lines. In this instance, the sealing member suffers from reduced sealing tightness in spite of biasing by the coil spring. The modified arrangement, however, does not suffer form such spaces which arise from the pressed or concave portions of the sealing member corresponding to the parting lines, because the rotation preventive means is employed. Therefore, it is possible to avoid, with high reliability, a reduction in the sealing tightness given by the sealing member.

In the illustrated embodiments, the valve member 44, 44' is slidable within the air-discharge passage constituted by including the air-discharge hole 42*d*, and the sealing member 44*c*, 44*c*' is held in abutting contact with the valve seat surface 42D to close the communication opening 42C while the rod portion 44*b*, 44*b*' is moved together with the sealing member 44*c*, 44*c*' in the direction in which the sealing member 44*c*, 44*c*' is separated away from the valve seat surface 42D to open the communication opening 42D. In this arrangement, the valve member 44, 44' (the rod portion 44*b*, 44*b*') slides within the air-discharge passage, and the communication opening 42C is closed by the sealing member 44*c*, 44*c*' which is held in abutting contact with the valve seat surface 42D while the communication opening 42C is opened when the rod portion is moved together with the sealing member so as to separated away from the valve seat surface 42D.

In the illustrated embodiments, the retaining means is constituted by the recessed retaining portion 44*d*, 44*d*' as the concave portion provided on the rod portion 44*b*, 44*b*' for retaining the sealing member 44*c*, 44*c*' thereon. In this arrangement, the sealing member 44*c*, 44*c*' is retained on the rod portion 44*b*, 44*b*' such that the sealing member is movable together with the rod portion in the direction to open and close the communication opening 42C, with a simple structure in which the rod portion is formed with the recessed retaining portion 44*d*, 44*d*' as the retaining means for retaining the sealing member. Therefore, it is possible to permit the sealing member to follow the movement of the rod portion with high reliability. The retaining means may be constituted by the concave portion such as a groove or a recess formed in the rod portion as described in the illustrated embodiments or may be constituted by a convex portion such as a protrusion formed on the rod portion on which the sealing member is retained.

In the illustrated embodiments, the valve portion of the valve member 44, 44' includes the valve head 44*a*, 44*a*' having a diameter larger than that of the rod portion 44*b*, 44*b*' and the sealing member 44*c*, 44*c*' is in contact with the valve head while being retained on the rod portion at its recessed retaining portion 44*d*, 44*d*'. Further, the valve head 44*a*, 44*a*' is opposed to the valve seat surface 42D with the sealing member 44*c*, 44*c*' interposed therebetween. In this arrangement, the sealing member 44*c*, 44*c*' is in contact with the valve head 44*a*, 44*a*' while being retained on the recessed retaining portion 44*d*, 44*d*' and the valve head 44*a*, 44*a*' is opposed to the valve seat surface 42D via the sealing member 44*c*, 44*c*', so that the sealing member exhibits its sealing function with high reliability.

In the modified embodiment, the sealing member 44*c*' is the annular member inserted on the rod portion 44*b*', and the rotation preventive means is provided between the rod portion 44*b*' and the sealing member 44*c*' for preventing the rod portion 44*b*' and the sealing member 44*c*' from rotating relative to each other. In this arrangement, the positional relationship between the contact surface of the sealing member at which the sealing member contacts the valve head and the rod portion and the surfaces of the valve head and the rod portion with which the sealing member is in contact do not change when the communication opening is closed. Accordingly, the communication opening can be opened and closed by the valve portion with high reliability, irrespective of the configuration of the valve head and the rod portion.

As described above, the rotation preventive means is provided by the structure that the rod portion 44*b*' has, at a portion thereof on which the sealing member 44*c*' is inserted, the non-circular cross sectional shape, such as the rectangular cross sectional shape. This arrangement assures, with the simple structure, that, when the valve member is placed in its open state to open the communication opening, the sealing member is moved together with the rod portion as a unitary component in a direction to open the communication opening, while also assuring that the sealing member can be prevented from rotating.

Where the sealing member is configured to be symmetrical in the direction of thickness or height thereof, the sealing member is assembled onto the rod portion irrespective of the orientation in its thickness direction, so as to avoid inappropriate or erroneous assembling of the sealing member onto the rod portion.

In the illustrated embodiments, the air-discharging device 15 includes the coil spring 45 as the spring member which biases the valve head 44*a*, 44*a*' in the direction in which the sealing member 44*c*, 44*c*' is held in abutting contact with the valve seat surface 42D. In this arrangement, the valve head is biased by the coil spring in the direction in which the sealing member is held in abutting contact with the valve seat surface, so that it is possible to assure increased sealing tightness given by the sealing member.

Referring next to FIGS. 10-13, there will be explained an-air discharging device 115 constructed according to a second embodiment of the invention. In this second embodiment, the same or similar reference numerals as used in the illustrated first embodiment are used to identify the corresponding components, and a detailed explanation of which is dispensed with.

Figure 11A:
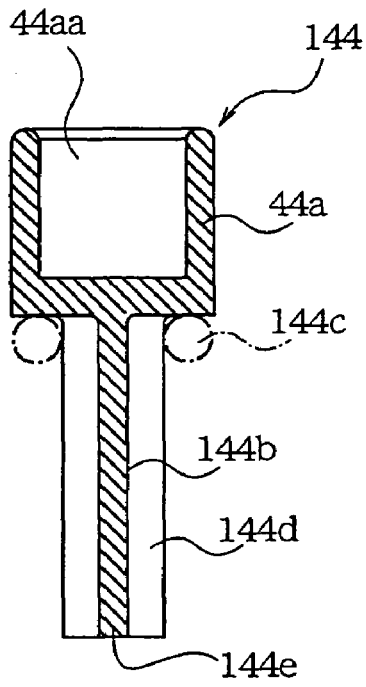
Figure 11B:
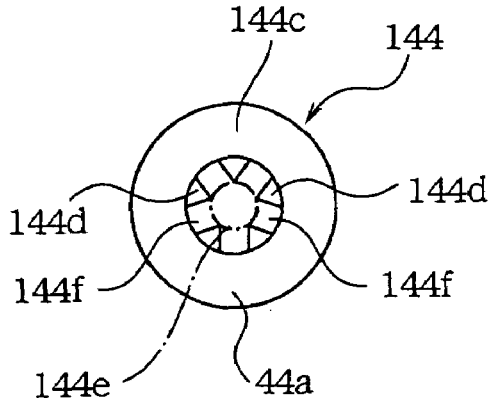

In this second embodiment, the air-discharging device 115 includes a valve member 144 shown in FIGS. 11A and 11B. Described more specifically, the valve member 144 includes: a valve portion having a large-diameter valve head 44*a* and a sealing member 144*c* whose outside diameter is substantially equal to that of the valve head 44*a*; and a rod portion 144*b* which is connected to the lower end of the valve head 44*a* and on which the sealing member 144*c* is inserted. The sealing member 144*c* is preferably a packing of rubber elastic body, for instance, and an O-ring is used in this embodiment. It is noted that the inside diameter of the sealing member 144*c* is not necessarily smaller than the outside diameter of the rod portion 144*b*. The rod portion 144*b* includes; a plurality of protruding portions 144*f* (five protruding portions in this embodiment) which are formed on the outer circumferential surface thereof such that the protruding portions extend in directions away from the center axis of the rod portion 144*b* and are equiangularly spaced apart from each other in the circumferential direction of the rod portion 144*b*; and a plurality of grooves 144*d* (five grooves in this embodiment) each of which is formed between adjacent two protruding portions 144*f*. In a different viewpoint, the protruding portions 144*f* protrude from an intersecting point 144*e* of a transverse cut plane of the rod portion 144*b* perpendicular to the sliding direction of the valve member 144 and the center axis line of the valve member 144 which extends in the sliding direction, such that the protruding portions 144*f* are equiangularly spaced apart from each other in the circumferential direction of the rod portion 144*b* centered about the intersecting point 144*e*. The number of the protruding portions 144*f* is made equal to the number of the grooves 144*d*. In the present embodiment, the grooves 144*d* are formed so as to extend over the entire axial length of the rod portion 144*b*. The number of the protruding portions 144*f* is not limited to five, but may be suitably determined as long as the protruding portions 144*f* are formed in a plural number and are arranged in the circumferential direction of the rod portion 144.

Each of the five grooves 144*d* formed in the rod portion 144*b* functions as a clearance for permitting passing of the air between the valve head 44*a* and sealing member 144*c* when the valve head 44*a* and the sealing member 144*c* are separated away form each other. Even if the air-discharge passage which is constituted by including the air-discharge hole 42*d* is contaminated with the ink and the sealing member 144*c* sticks to the valve seat surface 42D, the air can be effectively discharged owing to the clearances formed as described above.

Figure 10:
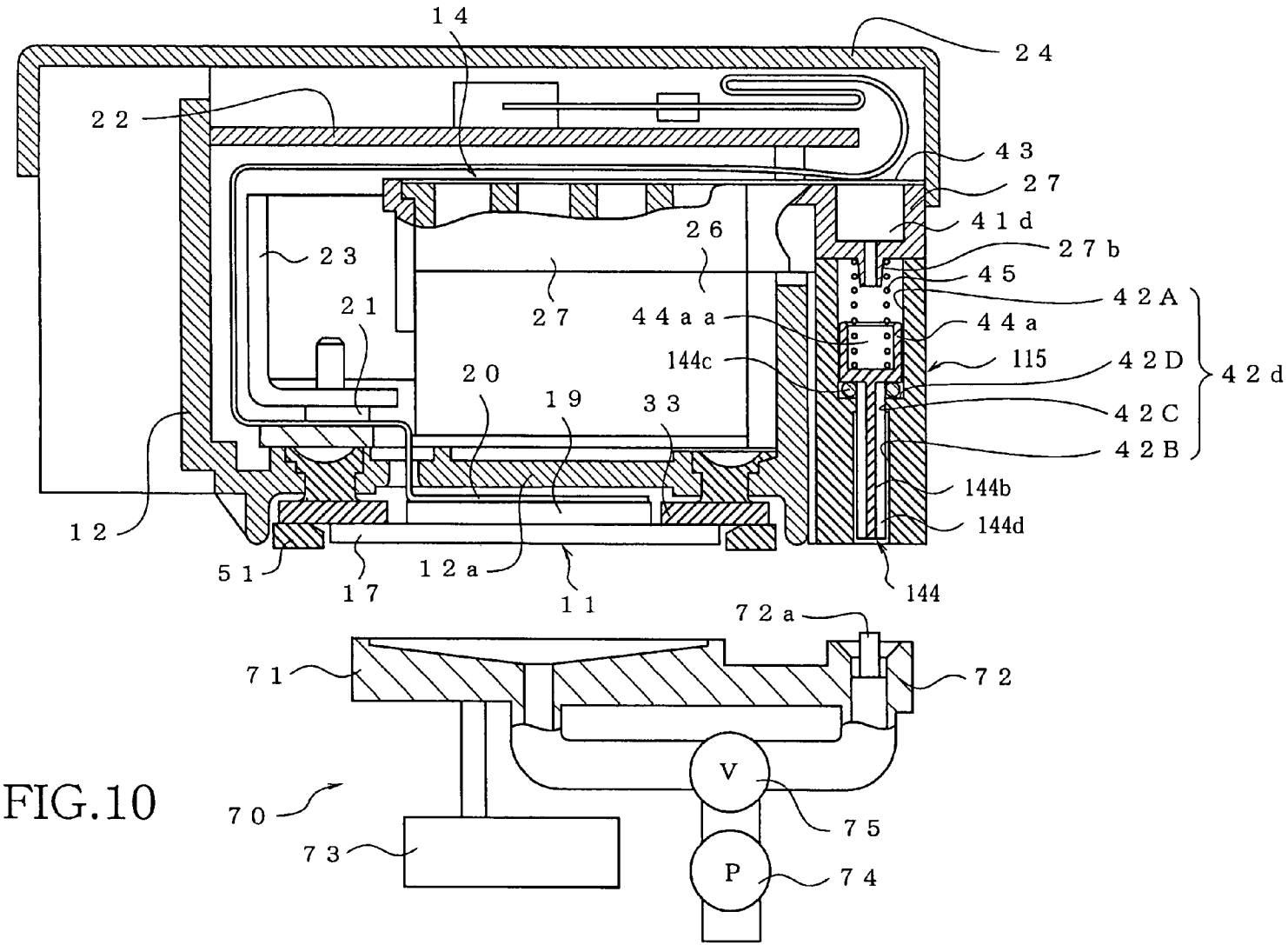
FIG. 10 is a cross sectional view corresponding to FIG. 6 and for explaining an air-discharging device according to a second embodiment of the invention.

During a printing operation, the valve member 144 is constantly pressed by the coil spring 45 in a downward direction and the sealing member 144*c* is held in abutting contact with the valve head 44*a* and the valve seat surface (namely, the sealing member 144*c* is pressed and held by and between the valve head 44*a* and the valve seat surface 42D). Thus, the valve member 144 is in its closed state (the valve-close state) in which the communication opening 42C is closed, as shown in FIG. 10.

Figure 12A:
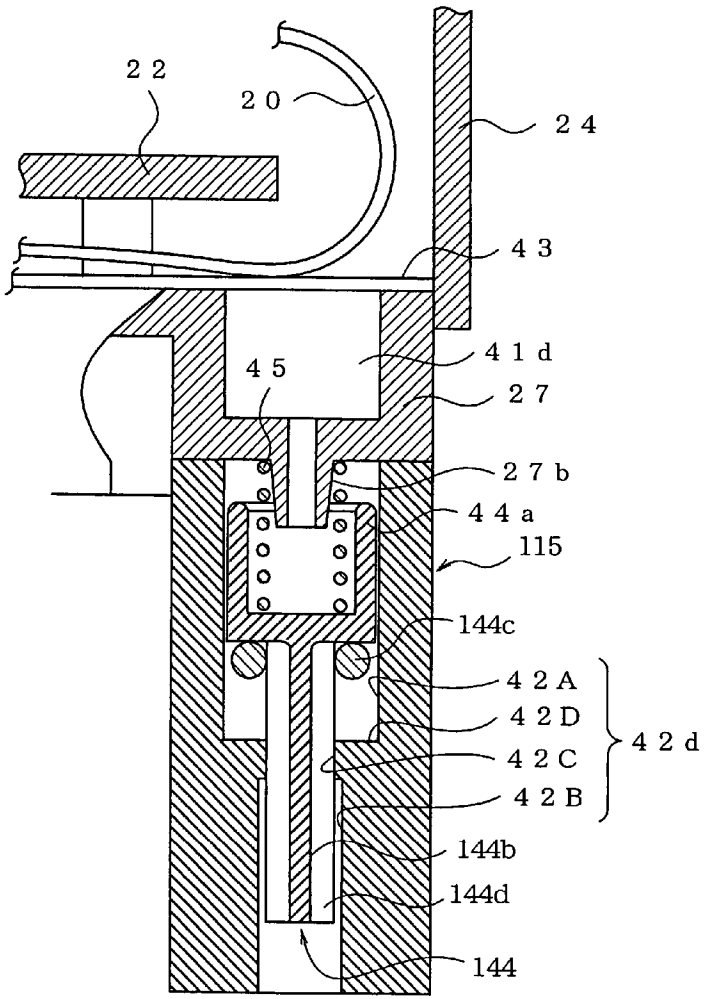
Figure 12B:
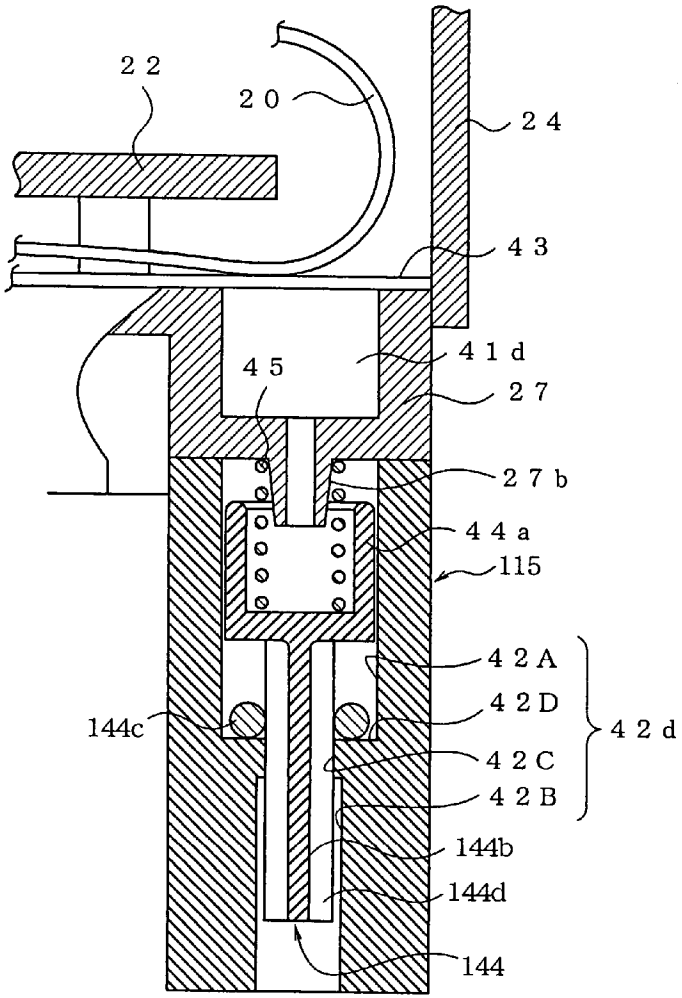

On the other hand, when the head holder 12 as the carriage is at its home position where the printing operation is not performed, the rod portion 144*b* is pushed up by the projecting shaft portion 72*a* of the second cap portion 72 of the maintenance unit 70 as explained above with respect to the illustrated first embodiment. (The structure and operation of the maintenance unit 70 have been explained in the first embodiment.) In this instance, the sealing member 144*c* is moved together with the valve head 44*a* as shown in FIG. 12A or remains on the valve seat surface 42D as shown in FIG. 12B. In either case, the air-discharge hole 42*d* communicates with the atmosphere through the grooves 144*d*, in other words, the valve member 144 is placed in its open state and the communication opening 42C is opened. Accordingly, in the valve-open state, the bubbles in the bubble accumulating chamber 31*d* can be discharged from the communication opening 42C via the small-diameter portion 42B and the suction pump 74.

In the valve-open state, even if only the rod portion 144*b* is moved upwards while the sealing member 144*c* remains on the valve seat surface 42D due to the ink adhering between the sealing member 144*c* and the valve seat surface 42D with which the sealing member 144*c* is in contact, for instance, the communication opening 42C is open via the grooves 144*d* as described above, whereby the air can be discharged. Therefore, the bubbles (the air) do not continue to accumulate in the bubble accumulating chambers 31*a*-31*d* and the bubbles (the air) do not move toward the printing head 11, so that the proper printing operation is not disturbed.

In the illustrated second embodiment, the rod portion 144*b* is formed with the grooves 144*d* for permitting passing of the air therethrough, so that there are provided the clearances for permitting passing of the air between the valve head 44*a* and the sealing member 144*c* when they are separated away from each other. The grooves 144*d* are not necessarily provided as explained below in a modified embodiment of the second embodiment, as shown in FIG. 13.

Figure 13:
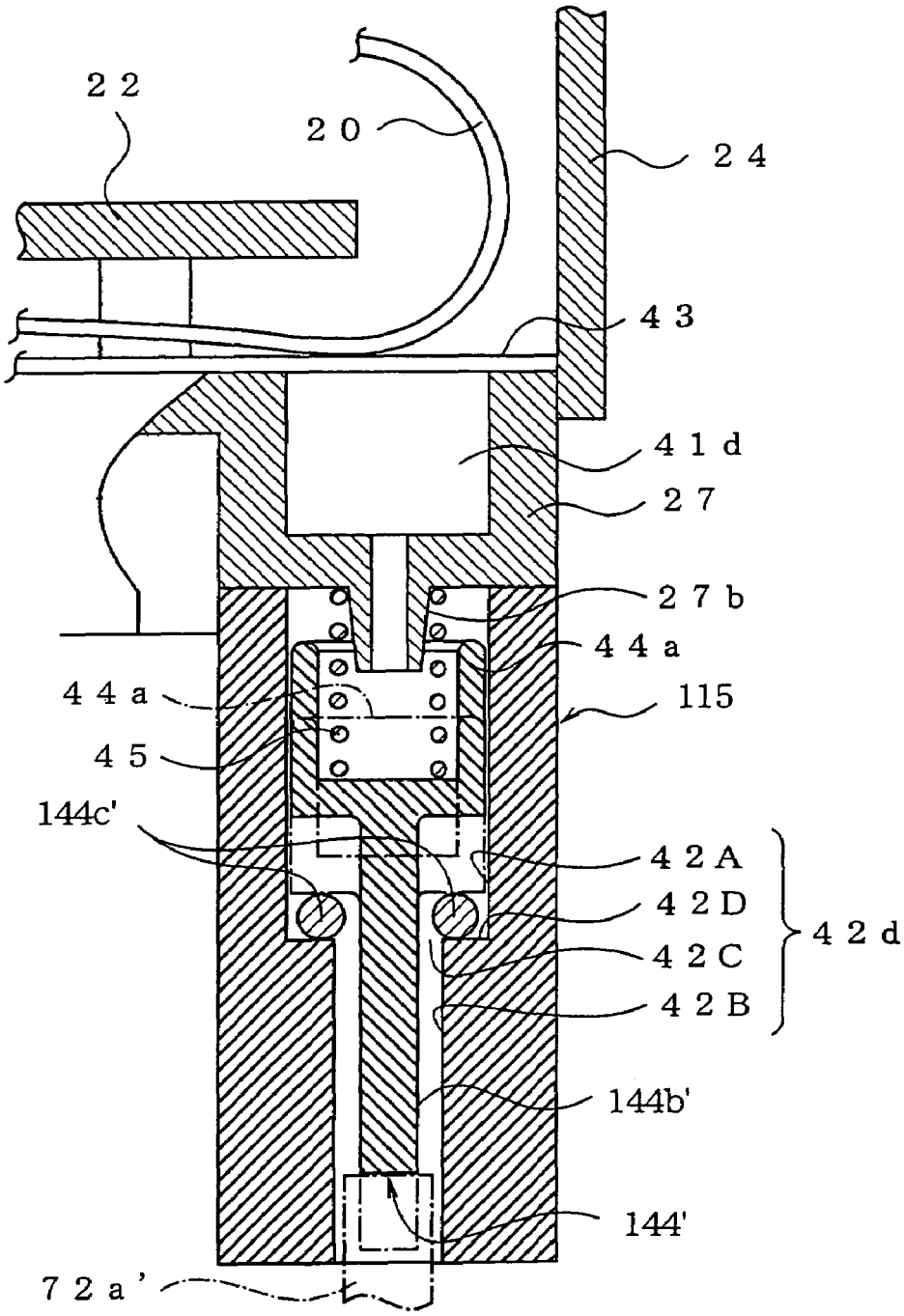
FIG. 13 is a view corresponding to FIG. 12B and for explaining an air-discharging device according to a modified embodiment of the second embodiment.

In the modified embodiment of FIG. 13, the air-discharging device 115 includes: a valve member 144' having a valve head 44*a* and a sealing member 144*c*'; and a rod portion 144*b*'. The communication opening 42C is opened when the rod portion 144*b*' is pressed at one end thereof remote from the valve head 44*a* by a projecting shaft portion 72*a*' (as the rod-portion-pushing member) of the maintenance unit 70 in a direction against the biasing force of the coil spring 45, while the communication opening 42C is closed when the rod portion 144*b*' is released from the pressing of the projecting shaft portion 72*a*'. The rod portion 144*b*' in this modified embodiment has an outside diameter which is smaller than an inside diameter of the sealing member 144*c*' and which is smaller than a diameter of the projecting shaft portion 72*a*'. According to this arrangement, the sealing member 144*c*' remains on the valve seat surface 42D when the rod portion 144*b*' is moved upwards. However, because there is an annular clearance between the valve member 144' (the rod portion 144*b*') and the sealing member 144*c*' for permitting a discharge flow of the air, the present arrangement enjoys the advantages similar to those described above with respect to the illustrated second embodiment. In this modified embodiment, the outside diameter of the rod portion 144*b*' is made smaller than the inside diameter of the ring-like sealing member 144*c*' in order to provide the annular clearance for permitting passing of the air between the valve head 44*a* and the sealing member 144*c*' when the valve head 44*a* and the sealing member 144*c*' are separated away from each other. In the meantime, the outside diameter of the rod portion 144*b*' is made smaller than the diameter of the projecting shaft portion 72*a*' for the following reasons: If the diameter of the projecting shaft portion 72*a*' is smaller than the outside diameter of the rod portion 144*b*', the projecting shaft portion 72*a*' may be put into space defined between the wall surface of the small-diameter portion 42B of the air-discharge hole 42*d* and the outer circumferential surface of the rod portion 144*b*', making it impossible to move the rod portion 144*b*' upwards by a predetermined distance that is required for opening the communication opening 42C.

In the illustrated first embodiment wherein the outside diameter of the rod portion 144*b* is made substantially equal to the inside diameter of the sealing member 144*c*, the rod portion 144*b* is formed with the grooves 144*d* as clearances that permit the discharge flow of the air therethrough. In the modified embodiment, the rod portion 144*b*' has the outside diameter smaller than the inside diameter of the sealing member 144*c*', whereby the annular clearance is provided therebetween for permitting the discharge flow of the air therethrough. Those two arrangements may be combined, in other words, the rod portion whose outside diameter is smaller than the inside diameter of the sealing member may be formed with the grooves. In this instance, the advantages similar to those explained above can be assured and it is possible to reduce a resistance to the flow of the air passing through the air-discharge passage. Moreover, even if the inside of the air-discharge passage is contaminated with the ink flowing from the buffer tank and the sealing member sticks to the valve head 44*a*, the resistance to the flow of the air passing through the air-discharge passage does not vary to a large extent, so that the intended air-discharging operation can be carried out with high reliability.

In the illustrated second and modified embodiments, the air-discharging device 115 includes the valve seat surface 42D formed around the communication opening 42C, the valve member 144, 144' is slidable within the air-discharge passage, and the sealing member 144*c*, 144*c*' is held in abutting contact with the valve head 44*a* and the valve seat surface 42D to close the communication opening 42C while the sealing member is separated away from at least one of the valve head 44*a* and the valve seat surface 42D to open the communication hole 42C. In this arrangement, the valve member 144, 144' (the rod portion 144*b*, 144*b*') slides in the air-discharge passage constituted by including the air-discharge hole 42*d*. The communication opening 42C can be closed by abutting contact of the sealing member 144*c*, 144*c*' with the valve head 44*a* and the valve seat surface while the communication opening 42C can be opened when the rod portion 144*b*, 144*b*' slides such that the sealing member 144*c*, 144*c*' is separated away from the valve head or the valve seat surface.

In the illustrated second embodiment, the clearances are constituted by the grooves 144*d* which are formed in the rod portion 144*b* to permit passing of the air therethrough. In this arrangement, the clearances for permitting passing of the air between the valve head 44*a* and the sealing member 144*c* when they are separated away from each other can be easily provided by forming the grooves 144*d* in the rod portion 144*b*. A single or a plurality of grooves 144*d* may be formed, as long as the discharge flow of the air can be assured. The grooves 144*d* may not extend over the entire axial length of the rod portion 144*b*.

In the illustrated second embodiment, the rod portion 144*b* includes the plurality of protruding portions 144*f* formed on the outer circumferential surface thereof such that the protruding portions extend in directions away from the center axis of the rod portion and are equiangularly spaced apart from each other in the circumferential direction of the rod portion, and each of the plurality of the grooves 144*d* are formed between adjacent two protruding portions 144*f*. In this arrangement, the grooves 144*d* are arranged so as to be equiangularly spaced apart from each other in the circumferential direction of the rod portion 144*b*, assuring the discharge flow of the air without eccentricity in the circumferential direction.

In the illustrated second embodiment, each of the five grooves 144*d* extends over the entire axial length of the rod portion 144*b*, so as to permit the air to flow through the grooves 144*d* by the sliding movement of the rod portion 144*b*, irrespective of where the sealing member 144*c* is located.

In the modified embodiment, the air-discharging device 115 includes: the sealing member 144*c*' having an annular shape and inserted on the rod portion 144*b*'; and the coil spring 45 that biases the valve member 144' in the sliding direction in which the valve member slides within the air-discharge passage, while the ink-jet printer includes the projecting shaft portion 72*a*' as the rod-portion-pushing member which is displaceable in a direction opposite to a direction in which the coil spring biases the valve member. Further, the valve head 44*a* is constantly biased by the coil spring 45 in a direction in which the sealing member 144*c*' is held in abutting contact with the valve seat surface 42D, and the rod portion 144*b*' is pressed, at one end thereof which is not connected to the valve head, by the projecting shaft portion 72*a*' in the direction against the biasing force of the coil spring to open the communication opening 42C while the rod potion is released from the pressing by the projecting shaft portion to close the communication opening, and the rod portion 144*b*' has the diameter which is smaller than the inside diameter of the sealing member 144*c*' and which is smaller than the diameter of the projecting shaft portion 72*a*'.

In the arrangement described above, the coil spring 45 constantly biases the valve head 44*a* in the direction in which the sealing member 144*c*' is held in abutting contact with the valve seat surface 42D in the valve-close state wherein the communication opening 42C is closed. When the rod portion 144*b*' is pressed at one end thereof remote from the valve head 44*a* by the projecting shaft portion 72*a*' of the second cap portion 72 of the maintenance unit 70, against the biasing force of the coil spring 45, the communication opening 42C is opened. When the rod portion 144*b*' is freed from the pressing by the projecting shaft portion 72*a*', on the other hand, the communication opening 42C is closed. Accordingly, the communication opening 42C can be reliably opened and closed. Further, in the arrangement described above, since the outside diameter of the rod portion 144*b*' is made smaller than the diameter of the projecting shaft portion 72*a*', the rod portion 144*b*' can be pushed, with high reliability, at one end thereof remote from the valve head 44*a*, by the projecting shaft portion 72*a*' against the biasing force of the coil spring 45.

Referring next to FIGS. 14-17, there will be explained an air-discharging device 215 constructed according to a third embodiment of the invention. In this third embodiment, the same or similar reference numerals as used in the illustrated first and second embodiments are used to identify the corresponding components, and a detailed explanation of which is dispensed with.

Figure 14:
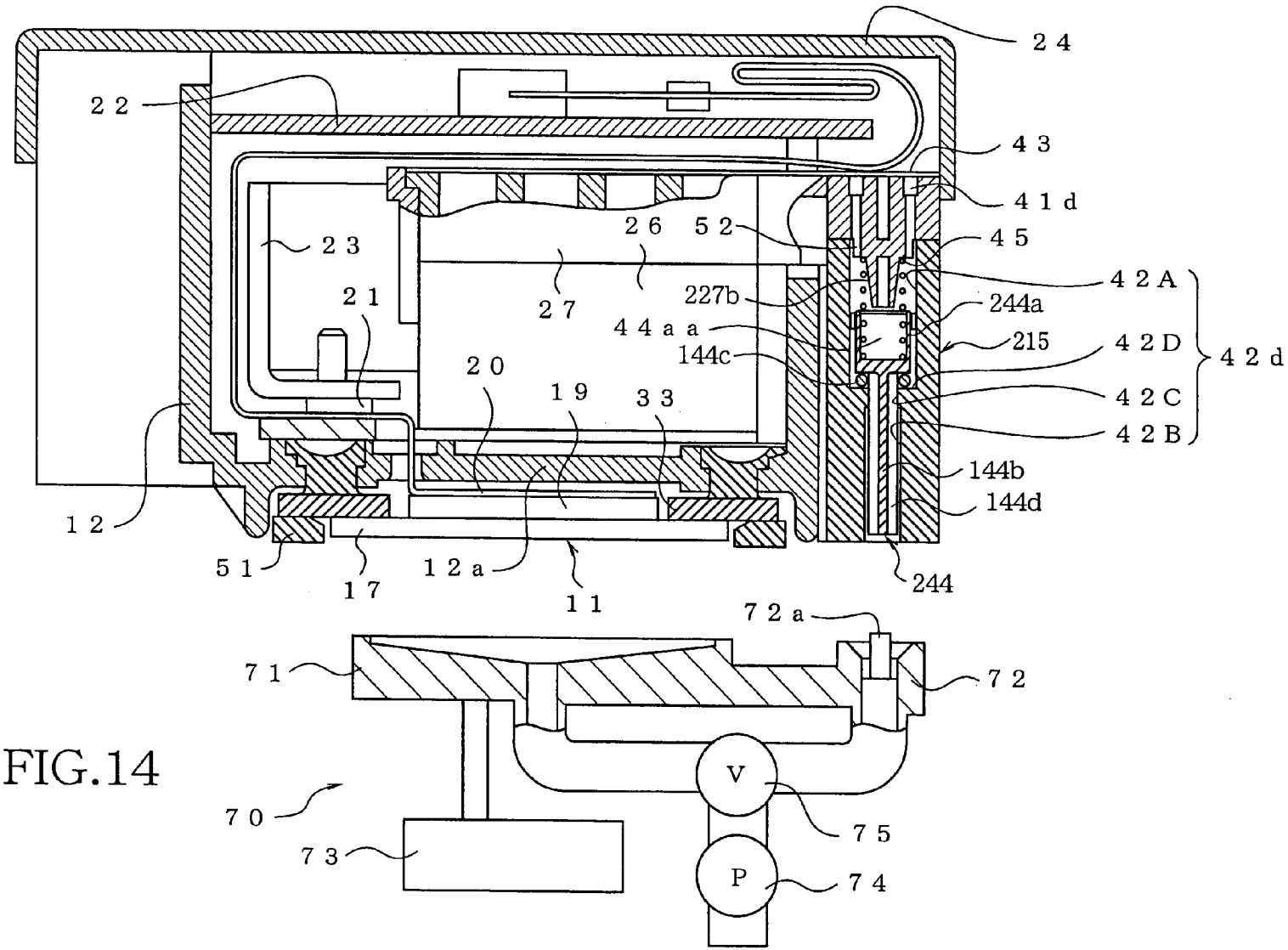
FIG. 14 is a cross sectional view corresponding to FIG. 6 and for explaining an air-discharging device according to a third embodiment of the invention.

In this third embodiment, the air-discharge hole 42*d* includes an air-inlet 52 and an air-outlet (which is constituted by the communication opening 42C in this embodiment) which are located at the axially opposite ends of the large-diameter portion 42A, as shown in FIG. 14. The air-discharge hole 42*d*, in detail, the large-diameter portion 42A functions as a valve chamber in which a valve member 244 (which will be described) slides. In this embodiment, the air-discharge passage is constituted by including the air-discharge hole 42*d*, the air-inlet 52, and the communication opening 42C (the air-outlet). (In FIG. 14, while there is shown only the air-discharge hole 42*d* having the large-diameter portion 42A, the small-diameter portion 42B, and the communication opening 42C (the air-outlet), the air-discharge holes 42*a*-42*c* have a structure similar to that of the air-discharge hole 42*d*.)

Figure 15A:
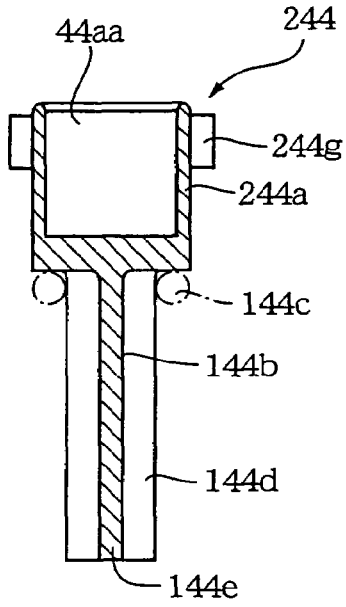
Figure 15B:
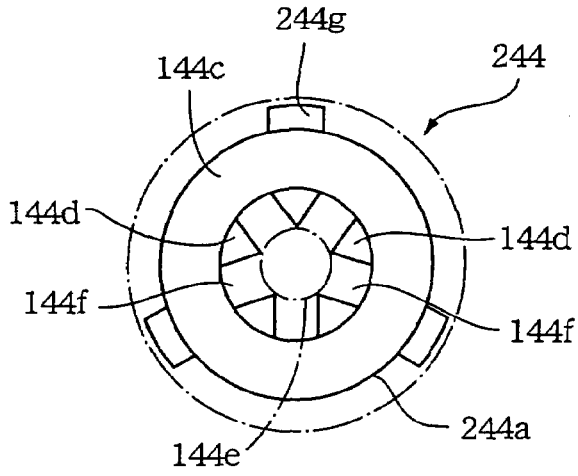

The air-discharging device 215 includes the valve member 244 shown in FIGS. 15A and 15B. Described more specifically, the valve member 244 includes: a valve portion having a large-diameter valve head 244*a* and a sealing member 144*c* whose outside diameter is substantially equal to that of the valve head 244*a* and which is provided to be in contact with the valve head 244*a*; and a rod portion 144*b* which is connected integrally to the lower end of the valve head 244 and on which the sealing member 144*c* is inserted. As in the illustrated second embodiment, the sealing member 144*c* is preferably a packing of rubber elastic body, for instance. An O-ring is used in this embodiment. It is noted that the inside diameter of the sealing member 144*c* is not necessarily smaller than the outside diameter of the rod portion 144*b*. As in the illustrated first embodiment, the valve head 244*a* is opposed, via the sealing member 144*c*, to the valve seat surface (stepped surface) 42D which is the bottom surface of the large-diameter portion 42A and which is formed around the communication opening 42C that is the upper open end of the small-diameter portion 42B. The large-diameter valve head 244*a* is inserted into the large-diameter portion 42A of the air-discharge hole 42*d* with spacing left therebetween for permitting the air (gas) to flow therethrough while the rod portion 144*b* is inserted into the small-diameter portion 42B with spacing being left therebetween for permitting the air (gas) to flow therethrough, so that the valve member 244 is slidably supported within the air-discharge hole 42*d* in its center axis direction. For placing the valve member 244 in its open state, the rod portion 144*b* needs to be pushed up by the projecting shaft portion 72 of the maintenance unit 70 as explained above. Accordingly, the lower end portion of the rod portion 144*b* inserted in the small-diameter portion 42B reaches in the vicinity of the lower open end of the small-diameter portion 42B when the valve member 244 is placed in its closed state. (The operation and the structure of the maintenance unit 70 has been explained in the illustrated first embodiment.)

As explained above, the stepped surface 42D around the communication opening 42C which communicates with the atmosphere functions as the valve seat surface, and the sealing member 144*c* is disposed between the valve seat surface 42D and the valve head 244*a*. Thus, the communication opening 42C (the air-outlet) is opened and closed by the valve head 244*a* via the sealing member 144*c* which is inserted on the rod portion 144*b*.

Within the large-diameter portion 42A, there is inserted the coil spring 45 as the biasing means for biasing the valve member 244 (the valve head 244*a*) in a direction to close the communication opening 42C. More specifically described, one end (the upper end) of the coil spring 45 (the spring member) is supported by the supporting protrusion 227*b* (formed on the upper casing member 27) that is disposed in the radially central portion of the valve chamber such that the coil spring 45 is inserted or fitted thereon, while the other end (the lower end) of the coil spring 45 is inserted or fitted into the upper recess 44*aa* of the valve head 244*a*. There are formed a plurality of air-inlets 52 around the supporting protrusion 227*b*. Namely, the upper end of the coil spring 45 is located between the air-inlets 52 and the supporting protrusion 227*b*. Thus, there is formed, radially outwardly of the coil spring 45, an air-flow path from the air-inlets 52 to the communication opening 42C (the air-outlet) through which the air is discharged.

Figure 16A:
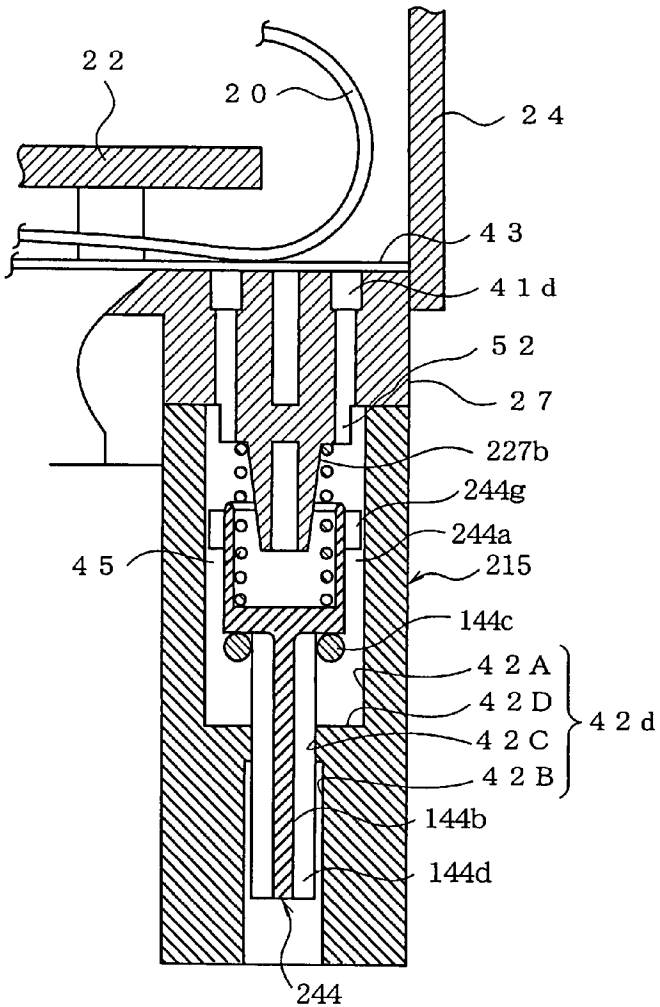
Figure 16B:
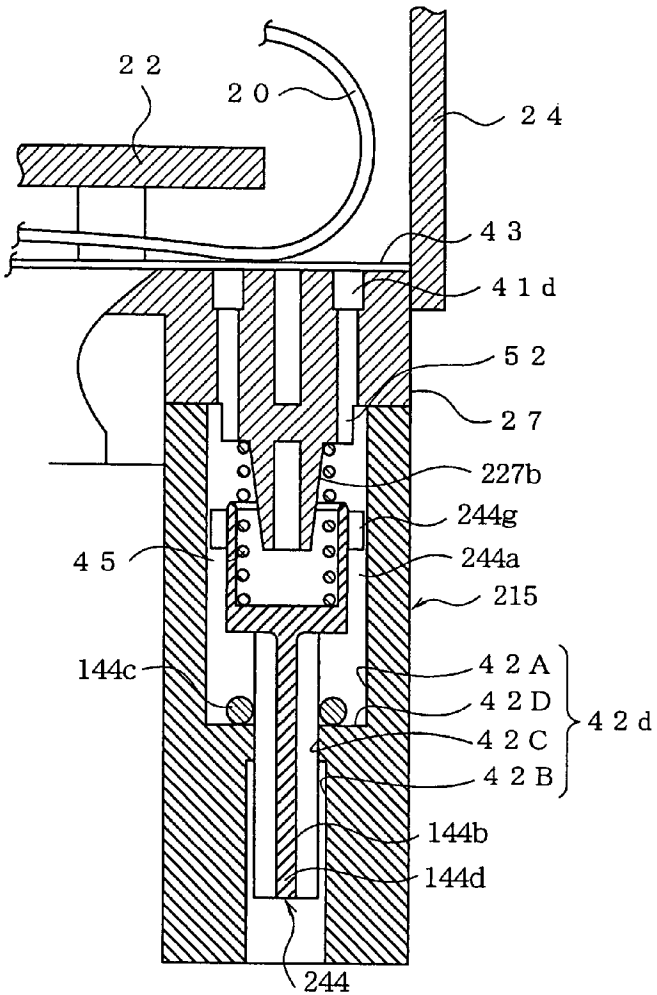

For discharging the air by opening the communication opening 42C, in particular, the rod portion 144*b* is slidably moved and accordingly the coil spring 45 is compressed. Therefore, the air flowing from the air-inlets 52 is not likely to flow into the inside of the coil spring 45 while, on the other hand, there is formed a smooth flow of the air between the inner wall surface (the inner circumferential surface) of the large-diameter portion 42A and the coil spring 45. In other words, the spacing between the inner wall surface of the large-diameter portion 42A and the outer surface of the coil spring 45, which spacing is relatively large in this embodiment, functions as a part of the air-flow path in which the resistance to flow of the air passing therebetween is low. Moreover, as shown in FIGS. 16A and 16B, the outer circumferential surface of the valve head 244*a* cooperates with the inner wall surface of the large-diameter portion 42A and the outer surface of the coil spring 45 to define the air-flow path extending from the air-inlets 52 to the communication opening 42C, in which there exist no obstacles that undesirably increase the resistance to flow of the air passing therethrough.

Because the sealing member 144*c* is constantly biased by the coil spring 45 in the direction in which the sealing member 144*c* is held in abutting contact with the valve seat surface 42D, the air-discharging device 215 is in its closed state, in other words, the valve member 244 is in its closed state (valve-close state) to close the communication opening 42C, in a normal state wherein the pressing force by the projecting shaft portion 72*a* of the maintenance unit 70 explained above does not act on the valve member 244.

As explained above with respect to the illustrated second embodiment, the rod portion 144*b* includes: the plurality of protruding portions 144*f* (five protruding portions 144*f*) which are formed on the outer circumferential surface thereof such that the protruding portions 144*f* extend in directions away from the center axis of the rod portion 144*b* and are equiangularly spaced apart from each other in the circumferential direction of the rod portion 144*b*; and the plurality of grooves 144*d* (five grooves 144*d*) each of which is formed between adjacent two protruding portions 144*f*. Further, in this embodiment, the valve head 244*a* is provided, on its outer surface, with a plurality of projections 244*g* which protrude toward the inner wall surface (the inner circumferential surface) of the large-diameter portion 42A and which are equiangularly spaced apart from each other in the circumferential direction of the valve head 244*a*. The projections 244*g* of the valve head 244*a* are configured such that, when the valve member 244 is inclined relative to the axis line of the discharge hole 42*d*, the valve member 44 is prevented from being largely inclined relative to the axis line of the air-discharge hole 42*d* owing to contact of the projections 244*g* with the inner wall surface of the large-diameter portion 42A, thereby assuring a smooth sliding movement of the valve member 244. Moreover, in this embodiment, the diameter of the communication opening 42C is made substantially equal to the outside diameter of the rod portion 144*b*, as shown in FIGS. 16A and 16B. This arrangement is also effective to prevent the valve member 244 from being inclined to a large extent relative to the axis line of the air-discharge hole 42*d*.

Accordingly, the outer surface of the valve head 244*a* cooperates with the inner wall surface of the large-diameter portion 42A to define a part of the air-flow path having a resistance to the flow of the air passing therethrough which does not suffer from eccectricity in the circumferential direction, thereby assuring a smooth discharge flow of the air and reducing the resistance to the discharge flow of the air. In view of the reduction of the resistance to the flow of the air, it is advantageous that each projection 244*g* formed on the valve head 244*a* has, in its plan view as seen in the sliding direction of the valve member 244, a circumferential dimension which is made as small as possible. Further, the area of contact between each projection 244*g* and the inner wall surface of the large-diameter portion may result in a resistance to the sliding movement of the valve member 244 to impede the smooth sliding movement of the same 244. In view of this, each projection 244*g* preferably extends in the sliding direction of the valve member 244 within a range wherein the smooth sliding movement of the same 244 is not disturbed. This arrangement is effective also in a viewpoint that it is easy to generate an air flow along the axis direction of the valve member 244.

Each of the above-described five grooves 144*d* formed in the rod portion 144*b* functions as a clearance (a part of the air-flow path) for permitting, with high reliability, passing of the air between the valve head 244*a* and the sealing member 144*c* when they are separated away from each other. Accordingly, even when only the rod portion 144*b* is moved upwards while the sealing member 144*c* remains on the valve seat surface 42D due to the bonding property exhibited by the ink that adheres between the sealing member 144*c* and the valve seat surface 42D with which the sealing member 144*c* is held in contact in the valve-close state, the air can be discharged through the grooves 144*d*. As a result, the bubbles (the air) do not continue to be accumulated in the bubble accumulating chambers 31-31*d* and the bubbles (the air) do not move toward the printing head 11, so that proper or normal printing operation is not disturbed by the bubbles (the air).

Figure 17:
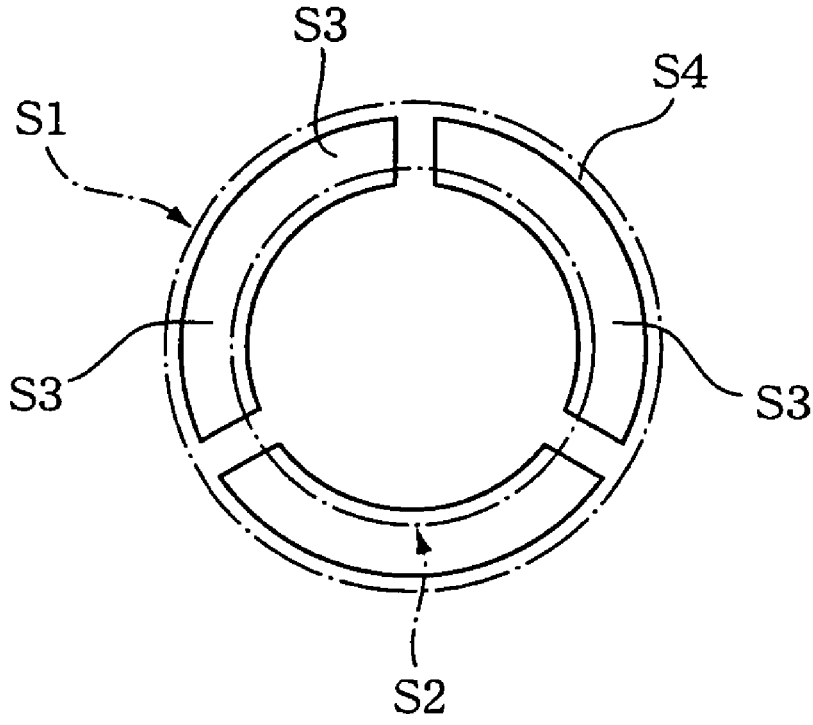
FIG. 17 is a view for explaining positional relationship between a valve-chamber image, a valve-head image, inlet images, and a spacing image.

Referring next to FIG. 17, there will be explained in detail positional relationship between (a) the valve chamber provided by the air-discharge hole 42*d*, in detail, by the large-diameter portion 42A and (b) the air-inlets 52 formed around the supporting protrusion 227*b*, in their plan view (i.e., in a state in which the valve chamber and the air-inlets 52 are projected in the sliding direction of the valve member 244). In FIG. 17 and the following explanation, S1, S2, S3, and S4 respectively correspond to a projected image of the valve chamber (the large-diameter portion 42A), a projected image of an outer profile of the valve head 244*a* (the valve-portion), projected images of the air-inlets 52 formed around the supporting protrusion 227*b*, and a projected image of a spacing which is defined by and between the projected image (S1) of the valve chamber and the projected image (S2) of the valve head 244*a* (i.e, a region sandwiched by and between the radially inner and outer one-dot chain lines in FIG. 17) and which corresponds to a part of the air-flow path. Those projected images S1-S4 are respectively referred to as "the valve-chamber image", "the valve-head image", "the inlet images", and "the spacing image".

The valve-head image S2 is located within the valve-chamber image S1. The spacing image S4 is formed between these two images S1, S2. The inlet images S3 overlap with the spacing image S4 so as to form the air-flow path through which the air to be discharged flows. The valve-chamber image S1 has a circular outer profile, and a plurality of the inlet images S3 (three images S3 in this embodiment) are located in concentric relation with the circular outer profile of the valve-chamber image S1.

For reducing the resistance to flow of the air passing through the air-flow path by obtaining a large cross-sectional area thereof, it is preferable that overlapping portions of the inlet images S3 which overlap with the spacing image S4 have an area larger than that of non-overlapping portions of the inlet images S3 which do not overlap with the spacing image S4. In the present embodiment, overlapping portions of the spacing image S4 which overlap with the inlet images S3 are arranged to have an area larger than that of non-overlapping portions of the spacing image S4 which do not overlap with the inlet images S3. This arrangement is also effective to reduce the resistance to flow of the air passing through the air-flow path.

Further, because the inlet images S3 are arranged to overlap with the spacing image S4, the air-flow path from the air-inlets 52 to the communication opening 42C is constituted by including path portions which extend linearly without being interrupted by any obstacles that disturb the air flow, thereby permitting the air to smoothly flow and contributing to a reduction in the resistance of flow of the air passing therethrough. For assuring the smooth flow of the air, while it is effective to minimize the area of the non-overlapping portions of the inlet-openings S3 which do not overlap with the spacing image S4 as explained above, it is noted that there exist, in the inlet images S3, the non-overlapping portions which do not overlap with the spacing image S4, as shown in FIG. 17. In this embodiment, however, the valve head 244*a* has a cylindrical lateral wall portion which extends upwardly from the periphery of the bottom wall portion thereof toward the air-inlets 52 for forming the recess 42*aa* into which the coil spring 45 is inserted and which has an upwardly convex top end portion having an arcuate shape in vertical cross section. According to this arrangement, although a part of the discharge flow of the air which has flowed from the air-inlets 52 is interrupted by the top end portion of the cylindrical lateral wall portion of the valve head 244*a*, the valve head 244*a* in this embodiment has the upwardly convex top end portion having the arcuate shape in vertical cross section as described above, so that the discharge flow of the air is not disturbed to a large extent and a substantial part of the air interrupted by the top end portion is smoothly introduced into the spacing between the inner wall surface of the large-diameter portion 42A and the outer surface of the cylindrical lateral wall portion of the valve head 244*a*. Further, because the area of the overlapping portions of the spacing image S4 which overlap with the inlet images S3 are made larger than the area of the non-overlapping portions of the spacing image S4 which do not overlap with the inlet images S3, the resistance of the flow of the air passing through the air-flow path is reduced. As shown in FIG. 17, the positional relationship between the spacing image S4 and the inlet images S3 is arranged such that a plurality of inlet images S3 (three images S3 in this embodiment) are disposed so as to be equiangularly spaced apart from each other in the circumferential direction of the spacing image S4 having a generally annular configuration.

The equiangular arrangement of the inlet images S3 is effective to assure the smooth discharge flow of the air and contributes to the reduction in the resistance of the discharge flow of the air passing through the air-flow path.

In the air-discharging device 215 of this embodiment, the air-flow path from the air-inlets 52 to the communication opening 42C is formed by including the linearly-extending path portions, and the path portions smoothly extend with no irregularities and steps that disturb the discharge flow of the air. Therefore, the smooth discharge flow of the air and the reduction in the resistance to the discharge flow can be realized more effectively.

In the air-discharging device 215 constructed as described above, in the normal state wherein the printing operation is performed, the valve member 244 is constantly pressed by the coil spring 45 in the downward direction and the communication opening 42C (the air-outlet) is closed with the sealing member 144*c* held in abutting contact with the valve head 244*a* and the valve seat surface 42D (i.e. with the sealing member 144*c* pressed and held by and between the valve head 244*a* and the valve seat surface 42D). Thus, the valve member 244 is placed in its closed state, as shown in FIG. 14.

When the head holder 12 as the carriage is at its home position where the printing operation is not performed, the rod portion 144*b* is pushed up by the projecting shaft portion 72*a* of the second cap portion 72 of the maintenance unit 70, so that the coil spring 45 is compressed. In this instance, the sealing member 144*c* is moved together with the valve head 244*a* as shown in FIG. 16A or remains on the valve seat surface 42D as shown in FIG. 16B. In either case, the air-discharge hole 42*d* communicates with the atmosphere via the grooves 144*d*, in other words, the valve member 244 is placed in its open state and the communication hole 42C (the air-outlet) is opened. Accordingly, the bubbles in the bubble accumulating chamber 31*d* can be discharged from the communication opening 42C via the small-diameter portion 42B and the suction pump 72.

Figure 18:
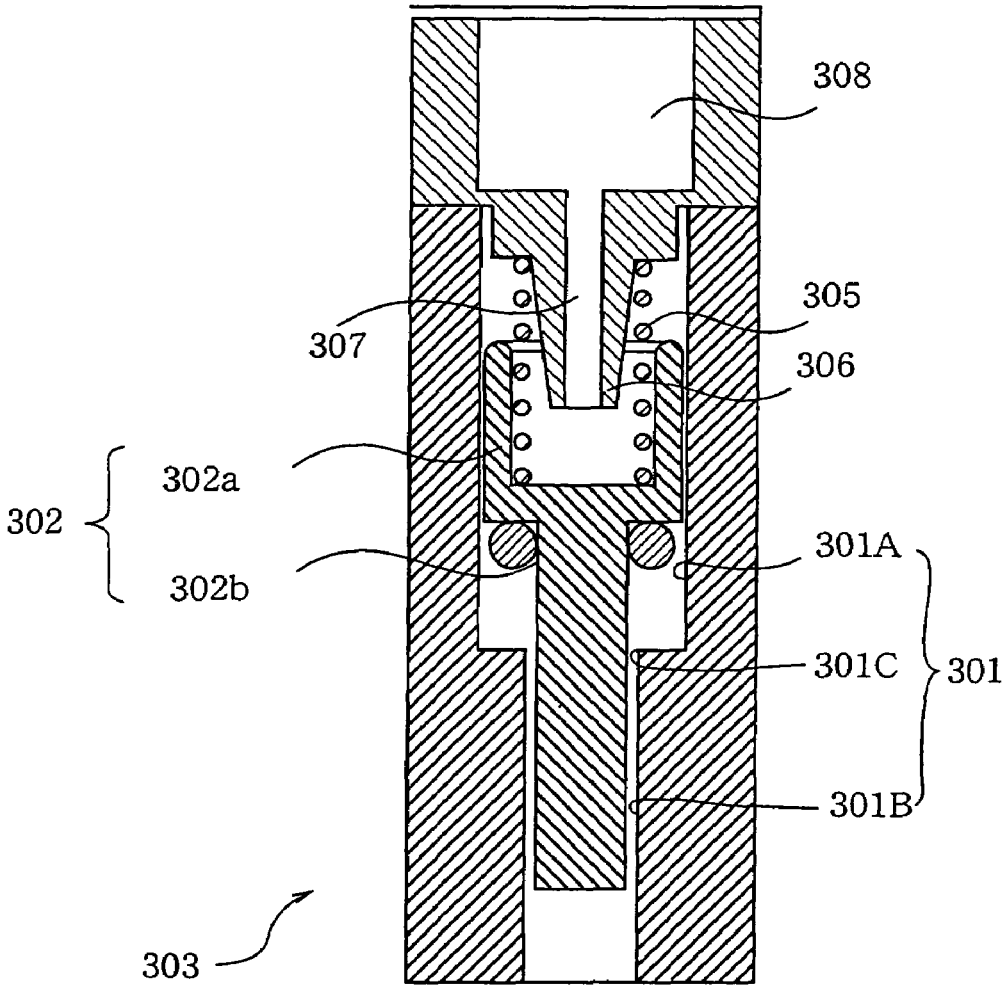
FIG.18 RELATED ART
FIG. 18 is a view for explaining a conventional arrangement.

In the arrangement described above, the plurality of air-inlets 52 through which the air is introduced into the air-discharge hole (the valve chamber) are formed radially outwardly of the coil spring 45 that is to be compressed in the valve-open state described above, it is avoided that the discharge amount of the air varies in every air-purging operation due to the increased resistance of the flow of the air which results from the compression of the coil spring, as experienced in the conventional arrangement shown in FIG. 18.

In this third embodiment, the valve head 244*a* is arranged to open and close the air-outlet. The valve portion may be arranged to open and close the air-inlet(s).

In the illustrated third embodiment, the valve member 244 is slidable within the valve chamber, and the air-discharging device 215 is arranged such that the communication hole 42C (the air-outlet) is opened when the coil spring 45 is compressed. According to this arrangement, the valve member 244 slides in the valve chamber, and the communication hole 42C is closed when the sealing member 144*c* is held in abutting contact with the valve seat surface 42D while the communication hole 42C is opened when the valve head 244*a* is removed or separated away from the valve seat surface 42D.

The air-discharging device 215 of the illustrated third embodiment includes: the valve seat surface 42D formed around the communication hole 42C (the air-outlet); the supporting protrusion 227*b* which is formed to be opposed to the communication hole 42C and by which the coil spring 45 is supported at one end thereof; and the recess 44*aa* formed in the valve head 244*a* for accommodating another end of the coil spring 45, and the air-inlets 52 are formed around the supporting protrusion 277*b*. According to this arrangement wherein the air-inlets 52 are formed around the supporting protrusion 227*b* by which the coil spring 45 is supported at the above-indicated one end (the upper end) thereof the air-flow path from the air-inlets 52 to the communication hole 42C can be easily formed so as to be located radially outwardly of the coil spring 45 disposed in the radially central portion of the valve chamber.

Further, since the above-indicated one end (the upper end) of the coil spring 45 is located between the supporting protrusion 227*b* and the air-inlets 52, the openings of the air-inlets 52 are kept open, whereby the air flows into the valve chamber through the entirety of the openings of the air-inlets 52 and is discharged from the communication opening 42C, assuring the smooth discharge flow of the air in every air-purging operation.

In the illustrated third embodiment wherein the (the valve head 244*a* is arranged to close the communication hole 42C (the air-outlet) via the sealing member 144*c* which is inserted on the rod portion 144*b*, the air flowing from the air-inlets 52 to the communication opening 42C can be interrupted, in the valve-close state, by the sealing member 144*c* with high reliability.

The valve head 244*a* in the illustrated third embodiment includes on its outer surface the plurality of projections 244*g* which are equiangularly spaced apart from each other in the circumferential direction of the valve head 244*a* so as to protrude toward the inner wall surface of the valve chamber. In this arrangement, the projections 244*g* are brought into contact with the inner wall surface of the valve chamber when the valve member 244 is inclined relative to the axis line of the air-discharge hole 42*d* during the sliding movement of the valve member 244 in the valve chamber, so as to prevent the valve member 244 from being inclined relative to the axis line of the air-discharge hole 42*d* to an excessively large extent. Therefore, the smooth sliding movement of the valve member 244 can be assured.

In the illustrated third embodiment, the valve-head image S2 is located within the valve-chamber image S1 while the spacing image S4 is located between those two images S1, S2, and at least a part of each inlet image S3 overlaps with the spacing image S4. This arrangement assures a stable discharge flow of the air at the outside of the coil spring 45, so that the air can flow without suffering from variation in its discharge amount in every air-purging operation.

In the illustrated third embodiment, the overlapping portions of the inlet images S3 which overlap with the spacing image S4 has an area larger than that of the non-overlapping portions of the inlet images S3 which do not overlap the spacing image S4. This arrangement assures a large area of the overlapping portions of the inlet images S3, so that the resistance to the flow of the air passing through the air-flow path is reduced and the smooth discharge flow of the air from the air-inlets 52 to the communication opening 42C is advantageously assured. Therefore, it is possible to prevent the discharge amount of the air from being varied in every air-purging operation.

In the illustrated third embodiment, the overlapping portions of the spacing image S4 which overlap with the inlet images S3 has an area larger than that of the non-overlapping portions of the spacing image S4 which do not overlap with the inlet images S3. This arrangement is advantageous for assuring the smooth discharge flow of the air from the air-inlets 52 to the communication hole 42C owing to the large area of the overlapping portions of the spacing image S4. Therefore, it is possible to prevent the discharge amount of the air from being varied in every air-purging operation.

In the illustrated third embodiment, the valve-chamber image S1 has the circular outer profile, and the plurality of the inlet images S3 are located in concentric relation with the circular outer profile of the valve-chamber image S1. According to this arrangement, the air-inlets 52 can be disposed so as to permit effective discharge flow of the air.

While the preferred embodiments of the present invention have been described above, it is to be understood that the invention is not limited to the details of the illustrated embodiments, but may be embodied with various other changes and modifications, which may occur to those skilled in the art, without departing from the spirit and scope of the invention.

What is claimed is:

1. An ink-jet printer, comprising:

a printing head for performing printing on a print medium by ejecting ink from nozzles;

an ink tank for storing the ink to be supplied to the printing head;

an ink passage through which the ink is supplied from the ink tank to the printing head;

a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber, the valve member having (a) a valve portion which opens and closes the communication opening and which includes a sealing member and (b) a rod portion connected to the valve portion, wherein the air-discharging device further includes air-discharge-flow assuring means for assuring a discharge flow of the air flowing from the buffer tank through the air-discharge passage, wherein the air-discharge-flow assuring means is realized by a structure that the air-discharging device includes retaining means for retaining the sealing member on the rod portion such that the sealing member is movable together with the rod portion in a direction to open and close the communication opening, and wherein the sealing member is an annular member inserted on the rod portion, and the valve member includes rotation preventive means provided between the rod portion and the sealing member for preventing the rod portion and the sealing member from rotating relative to each other.

2. The ink-jet printer according to claim 1, wherein the air-discharging device includes a valve seat surface formed around the communication opening, and wherein the valve member is slidable within the air-discharge passage, and the sealing member is held in abutting contact with the valve seat surface so as to close the communication opening while the rod portion is moved together with the sealing member in a direction in which the sealing member is separated away from the valve seat surface so as to open the communication opening.

3. The ink-jet printer according to claim 2, wherein the valve portion of the valve member includes a valve head having a diameter larger than that of the rod portion and the sealing member is in contact with the valve head while being retained by the retaining means, and wherein the valve head is opposed to the valve seat surface with the sealing member interposed therebetween.

4. The ink-jet printer according to claim 3, wherein the air-discharging device includes a spring member which biases the valve head in a direction in which the sealing member is held in abutting contact with the valve seat surface.

5. The ink-jet printer according to claim 1, wherein the retaining means is constituted by at least one of a concave portion and a convex portion provided on the rod portion for retaining the sealing member thereon.

6. The ink-jet printer according to claim 1, wherein the rotation preventive means is provided by a structure that the rod portion has, at a portion thereof on which the sealing member is inserted, a non-circular shape in cross section.

7. The ink-jet printer according to claim 1, wherein the sealing member is symmetrical in a direction of thickness thereof.

8. An ink-jet printer, comprising:

a printing head for performing printing on a print medium by ejecting ink from nozzles;

an ink tank for storing the ink to be supplied to the printing head;

an ink passage through which the ink is supplied from the ink tank to the printing head;

a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber, the valve member having (a) a valve portion which opens and closes the communication opening and which includes a sealing member and (b) a rod portion connected to the valve portion, wherein the air-discharging device further includes air-discharge-flow assuring means for assuring a discharge flow of the air flowing from the buffer tank through the air-discharge passage, and wherein the valve portion further includes a valve head connected to the rod portion and backing the sealing member which is held on the rod portion, and the air-discharge-flow assuring means is realized by a structure that the air-discharging device is configured to have at least one clearance between the rod portion and the sealing member, for permitting passing of the air between the valve head and the sealing member when the valve head and the sealing member are separated away from each other.

9. The ink-jet printer according to claim 8, wherein the air-discharging device includes a valve seat surface formed around the communication opening, and wherein the valve member is slidable within the air-discharge passage, and the sealing member is held in abutting contact with the valve head and the valve seat surface so as to close the communication opening while the sealing member is separated away from at least one of the valve head and the valve seat surface so as to open the communication opening.

10. The ink-jet printer according to claim 8, wherein the at least one clearance is constituted by at least one groove which is formed in the rod portion to permit passing of the air therethrough.

11. The ink-jet printer according to claim 10, wherein the rod portion includes: a plurality of protruding portions which are formed on the outer circumferential surface thereof such that the plurality of protruding portions extend in directions away from a center axis of the rod portion and are equiangularly spaced apart from each other in a circumferential direction of the rod portion; and a plurality of grooves as the at least one groove, each of the plurality of grooves being formed between adjacent two of the plurality of protruding portions.

12. The ink-jet printer according to claim 11, wherein the plurality of grooves consist of five grooves each of which extends over an entire axial length of the rod portion.

13. The ink-jet printer according to claim 8, wherein the air-discharging device includes: the sealing member having an annular shape and inserted on the rod portion; and a spring member which biases the valve member in a sliding direction in which the valve member slides within the air-discharge passage;

wherein the ink-jet printer includes a rod-portion-pushing member which is displaceable in a direction opposite to a direction in which the biasing member biases the valve member, wherein the valve head is constantly biased by the spring member in a direction in which the sealing member is held in abutting contact with the valve seat surface, and the rod portion is pressed at one end thereof which is not connected to the valve head by the rod-portion-pushing member in a direction against biasing force of the spring member with which the spring member biases the valve head so as to open the communication opening while the rod potion is released from the pressing by the rod-portion-pushing member so as to close the communication opening, and wherein the rod portion has a diameter smaller than a diameter of the rod-portion-pushing member.

14. An ink-jet printer, comprising:

a printing head for performing printing on a print medium by ejecting ink from nozzles;

an ink tank for storing the ink to be supplied to the printing head;

an ink passage through which the ink is supplied from the ink tank to the printing head;

a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber, the valve member having (a) a valve portion which opens and closes the communication opening and which includes a sealing member and (b) a rod portion connected to the valve portion, wherein the air-discharging device further includes air-discharge-flow assuring means for assuring a discharge flow of the air flowing from the buffer tank through the air-discharge passage, wherein the air-discharge passage has an air-inlet through which the air accumulated in the buffer tank is introduced into the valve chamber and an air-outlet from which the air introduced into the valve chamber is flowed out therefrom, one of the air-inlet and the air-outlet being the communication opening, wherein the air-discharging device further includes a spring member which biases the valve portion in a direction to close the one of the air-inlet and the air-outlet, and wherein the air-discharge-flow assuring means is realized by a structure that an air-flow path from the air-inlet to the air-outlet is formed radially outwardly of the spring member which is disposed in a radially central portion of the valve chamber.

15. The ink-jet printer according to claim 14, wherein the valve member is slidable within the valve chamber, and the air-discharging device is arranged such that the one of the air-inlet and the air-outlet is opened when the spring member is compressed.

16. The ink-jet printer according to claim 14, wherein the air-discharging device includes: a valve seat surface formed around the one of the air-inlet and the air-outlet; a supporting protrusion which is formed to be opposed to the one of the air-inlet and the air-outlet and by which the spring member is supported at one end thereof; and a recess formed in the valve portion of the valve member and accommodating another end of the spring member therein, and wherein the other of the air-inlet and the air-outlet is formed around the supporting protrusion.

17. The ink-jet printer according to claim 16, wherein the one end of the spring member is located between the supporting protrusion and the other of the air-inlet and the air-outlet.

18. The ink-jet printer according to claim 16, wherein, where projected images of the valve chamber, the valve portion, the other of the air-inlet and the air-outlet, and a spacing corresponding to a part of the air-flow path, which projected images are formed when projected in a sliding direction of the valve member, are respectively referred to as a valve-chamber image, a valve-portion image, an inlet/outlet image, and a spacing image, the valve-portion image is located within the valve-chamber image and the spacing image is defined by and between the valve-chamber image and the valve-portion image, and wherein at least a part of the inlet/outlet image overlaps with the spacing image.

19. The ink-jet printer according to claim 18, wherein an overlapping portion of the inlet-outlet image which overlaps with the spacing image has an area larger than that of a non-overlapping portion of the inlet/outlet image which does not overlap with the spacing image.

20. The ink-jet printer according to claim 18, wherein an overlapping portion of the spacing image which overlaps with the inlet/outlet image has an area larger than that of a non-overlapping portion of the spacing image which does not overlap with the inlet/outlet image.

21. The ink-jet printer according to claim 18, wherein the other of the air-inlet and the air-outlet is provided in a plural number so as to form a plurality of the inlet/outlet images, and wherein the valve-chamber image has a circular outer profile and the plurality of the inlet/outlet images are located in concentric relation with the circular outer profile of the valve-chamber image.

22. The ink-jet printer according to claim 14, wherein the valve portion is arranged to close the one of the air-inlet and the air-outlet via the sealing member which is inserted on the rod portion.

23. The ink-jet printer according to claim 14, wherein the valve portion includes on an outer surface thereof a plurality of protrusions which are equiangularly spaced apart from each other in a circumferential direction of the valve portion so as to protrude toward an inner circumferential surface of the valve chamber.

24. The ink-jet printer according to claim 23, wherein the one of the air-inlet and the air-outlet into which the rod portion is inserted has a diameter which is substantially equal to a diameter of the rod portion.

25. An ink-jet printer, comprising:

a printing head for performing printing on a print medium by ejecting ink from nozzles;

an ink tank which stores the ink to be supplied to the printing head;

an ink passage through which the ink is supplied from the ink tank to the printing head;

a buffer tank which stores the ink supplied through the ink passage; and an air-discharging device which discharges an air accumulated in the buffer tank through an air-discharge passage and which includes a valve member operable to open and close a communication opening provided in the air-discharge passage, the valve member having (a) a valve portion which includes a valve head and a sealing member that is backed by the valve head and which opens and closes the communication opening and (b) a rod portion which is connected at one end thereof to the valve head and on which the sealing member is held, wherein the air-discharging device is configured to have at least one clearance between the rod portion and the sealing member, for permitting passing of the air between the valve head and the sealing member when the valve head and the sealing member are separated away from each other.

26. An ink-jet printer, comprising:

a printing head for performing printing on a print medium by ejecting ink from nozzles;

an ink tank which stores the ink to be supplied to the printing head;

an ink passage through which the ink is supplied from the ink tank to the printing head;

a buffer tank which stores the ink supplied through the ink passage; and an air-discharging device that discharges an air accumulated in the buffer tank through an air-discharge passage a part of which functions as a valve chamber, the air-discharging device including:

a valve chamber having an air-inlet through which the air accumulated in the buffer tank is introduced into the valve chamber and an air-outlet through which the air introduced into the valve chamber is flowed out therefrom;

a valve member operable to open and close one of the air-inlet and the air-outlet and having (a) a valve portion which opens and closes the one of the air-inlet and the air-outlet and (b) a rod portion connected to the valve portion; and a spring member which biases the valve portion in a direction to close the one of the air-inlet and the air-outlet, wherein an air-flow path from the air-inlet to the air-outlet is formed radially outwardly of the spring member which is disposed in a radially central portion of the valve chamber.

* * * * *